US009442409B2

(12) United States Patent
Hano et al.

(10) Patent No.: US 9,442,409 B2
(45) Date of Patent: Sep. 13, 2016

(54) IMAGE FORMING APPARATUS

(71) Applicant: CANON KABUSHIKI KAISHA, Tokyo (JP)

(72) Inventors: Masami Hano, Abiko (JP); Yutaka Koga, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/497,119

(22) Filed: Sep. 25, 2014

(65) Prior Publication Data

US 2015/0093123 A1 Apr. 2, 2015

(30) Foreign Application Priority Data

Sep. 27, 2013 (JP) ..... 2013-202551

(51) Int. Cl.

*G03G 15/00* (2006.01)
*G03G 15/02* (2006.01)
*G03G 21/18* (2006.01)

(52) U.S. Cl.

CPC ..... *G03G 15/0266* (2013.01); *G03G 15/50* (2013.01); *G03G 15/502* (2013.01); *G03G 15/55* (2013.01); *G03G 21/1817* (2013.01)

(58) Field of Classification Search

USPC ..... 399/12, 50, 174–176
See application file for complete search history.

(56) References Cited

U.S. PATENT DOCUMENTS 6,639,617 B2 * 10/2003 Yokogawa ..... 347/130
6,917,770 B2 * 7/2005 Bae et al. ..... 399/44
7,693,437 B2 * 4/2010 Hano et al. ..... 399/49
7,705,866 B2 * 4/2010 Gomi et al. ..... 347/228
8,041,259 B2 * 10/2011 Narita et al. ..... 399/115
8,831,450 B2 * 9/2014 Hano ..... 399/50

FOREIGN PATENT DOCUMENTS

JP H06-003891 A 1/1994
JP 2003-015386 A 1/2003
JP 2003-208076 A 7/2003
JP 2006-030929 A 2/2006
JP 2006-030963 A 2/2006
JP 2012-018265 A 1/2012

* cited by examiner

*Primary Examiner* — Clayton E Laballe
*Assistant Examiner* — Warren K Fenwick
(74) *Attorney, Agent, or Firm* — Canon USA, Inc IP Division

(57) ABSTRACT

An image forming apparatus includes, a unit including at least a photosensitive member and a charging member detachable from a main body of the image forming apparatus, a current detection unit configured to detect a current flowing between the charging member and the photosensitive member, an operation unit configured to be operated by an operator to give an instruction to the image forming apparatus, a display unit provided in the operation unit, and a control unit configured to apply to the charging member a predetermined test voltage having an absolute value greater than a discharge starting voltage based on the instruction from the operation unit, and to perform an operation in a mode for causing the current detection unit to detect a current, wherein the control unit determines, based on the current detected in the mode, whether an error indication is to be given on the display unit.

11 Claims, 20 Drawing Sheets

IMAGE FORMING APPARATUS

BACKGROUND OF THE INVENTION

1. Field of the Invention

The present invention relates to an image forming apparatus such as a printer, a copying machine, or a facsimile using an electrophotographic method or an electrostatic recording method.

2. Description of the Related Art

Conventionally, for example, an image forming apparatus using an electrophotographic method employs a process cartridge method for integrating an electrophotographic photosensitive member (a photosensitive member) and process units acting on the electrophotographic photosensitive member into a cartridge, and making the cartridge attachable to and detachable from the main body of the image forming apparatus. The process units include, for example, a charging unit, a development unit, a cleaning unit, a static elimination unit for eliminating static from the photosensitive member, and a toner charging unit for charging transfer residual toner on the photosensitive member.

In the process cartridge method, generally, when a developer stored in a development device serving as the development unit has run out, or when the photosensitive member has come to the end of its life, an operator such as a user or a serviceman replaces the process cartridge, thereby enabling the image forming apparatus to form an image again.

The publication of Japanese Patent Application Laid-Open No. 2006-30963 discusses a technique for detecting whether a process cartridge is correctly attached to a main body of an image forming apparatus. According to the publication of Japanese Patent Application Laid-Open No. 2006-30963, after the process cartridge has been attached to the main body of the image forming apparatus, the image forming apparatus applies a voltage to the process cartridge. Then, if the process cartridge is normally attached to the main body of the image forming apparatus, an electrical contact on the apparatus main body side and an electrical contact on the process cartridge side become electrically connected together, and a current flows between the process cartridge and the apparatus main body. If this current cannot be detected, notification is given that the process cartridge is not attached in a normal position.

There is a process cartridge having a structure where the charging member can be attached to and detached from the process cartridge. In the case of a process cartridge having such a structure, for example, when maintaining the process cartridge, a serviceman may detach the charging member from the process cartridge, clean the charging member, and attach the cleaned charging member to the process cartridge again. In such a case, the charging member may be shifted from the normal position when attached to the process cartridge. In this case, it is possible that a current flows to the charging member. However, the discharge gap between the photosensitive member and the charging member may change in the longitudinal direction of the charging member. This may result in a charging failure.

The technique discussed in the publication of Japanese Patent Application Laid-Open No. 2006-30963 cannot detect the above case even if the process cartridge is attached in the normal position. Further, the act of attaching or detaching the charging member to or from the process cartridge is not frequently performed, but is occasionally performed by an operator such as a serviceman intending to attach or detach the charging member. Even though the charging member has obviously not been attached to or detached from the process cartridge, if the detection is made when the image forming apparatus is turned on or every time an opened door is closed to replace the process cartridge as in the publication of Japanese Patent Application Laid-Open No. 2006-30963, it may take extra time.

Thus, it is necessary to detect the state where a charging member is attached to a process cartridge in a shifted manner, and also to reduce excessive time.

SUMMARY OF THE INVENTION

According to an aspect of the present invention, an image forming apparatus includes, a photosensitive member, a charging member configured to discharge in contact with the photosensitive member to charge a surface of the photosensitive member, a power source configured to apply a voltage to the charging member, a toner image forming unit configured to form a toner image on the surface of the photosensitive member charged by the charging member, a unit including at least the photosensitive member and the charging member and attachable to and detachable from a main body of the image forming apparatus, the charging member being attachable to and detachable from the unit, a current detection unit configured to detect a current flowing between the charging member and the photosensitive member, an operation unit configured to be operated by an operator to give an instruction to the image forming apparatus, the operation unit including a display unit configured to display information to the operator, and a control unit configured to apply to the charging member a predetermined test voltage having an absolute value greater than a discharge starting voltage at which the discharge is started between the charging member and the photosensitive member based on the instruction from the operation unit, and to perform an operation in a mode for causing the current detection unit to detect a current when the test voltage has been applied, wherein the control unit determines, based on the current detected by the current detection unit in the mode, whether an error indication is to be given on the display unit.

Further features of the present invention will become apparent from the following description of exemplary embodiments with reference to the attached drawings.

DESCRIPTION OF THE EMBODIMENTS

An image forming apparatus according to the present invention will be described in more detail below with reference to the drawings.

The first exemplary embodiment of the present invention will be described below.

1. Overall Configuration and Operation of Image Forming Apparatus

Figure 1:
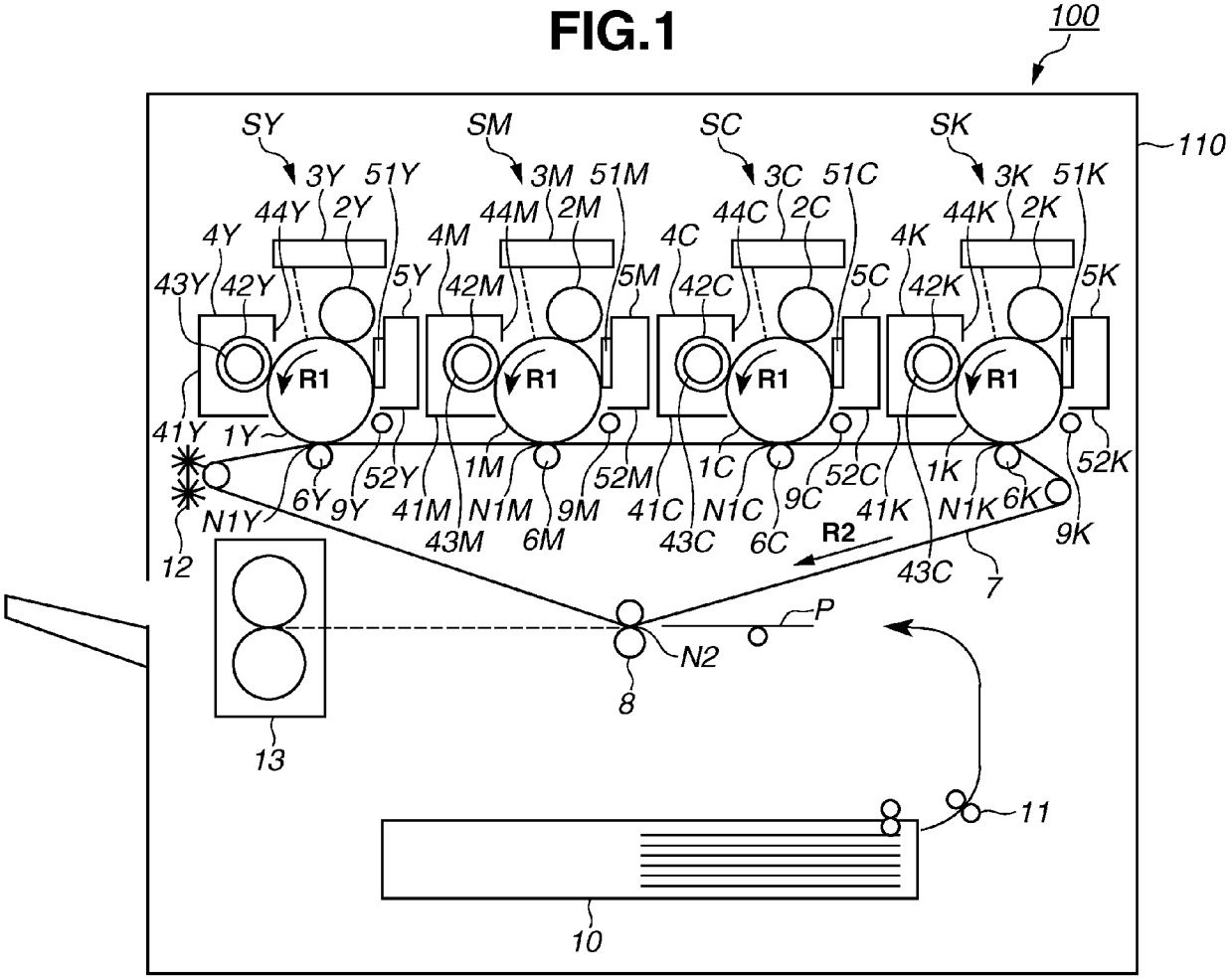
FIG. 1 is a schematic cross-sectional view of an image forming apparatus.

FIG. 1 is a schematic cross-sectional view of an image forming apparatus according to a first exemplary embodiment of the present invention. An image forming apparatus 100 according to the present exemplary embodiment is a tandem full-color image forming apparatus using an intermediate transfer method.

The image forming apparatus 100 according to the present exemplary embodiment includes first, second, third, and fourth image forming units (stations) SY, SM, SC, and SK as a plurality of image forming units. The image forming units SY, SM, SC, and SK form yellow (Y), magenta (M), cyan (C), and black (K) images, respectively. In the present exemplary embodiment, the configurations and the operations of the image forming units SY, SM, SC, and SK are substantially the same except that the colors of toner to be used are different from one another. Thus, when the components of the image forming units SY, SM, SC, and SK do not particularly need to be distinguished from one another, the components are collectively described by omitting the letters and "Y", "M", "C", and "K" at the ends of the respective numerals indicating the colors for which the components are provided.

The image forming unit S includes a drum-type (cylindrical) photosensitive member (photosensitive drum) 1 as an image bearing member. The photosensitive member 1 is driven to rotate in the direction of an arrow R1 in FIG. 1 by a driving motor (not illustrated) serving as a driving unit provided in an apparatus main body 110 of the image forming apparatus 100. Around the photosensitive member 1, the following units are arranged in order along the rotational direction of the photosensitive member 1. First, a charging device 2 is placed as a charging unit. Next, an exposure device 3 is placed as an exposure unit. Next, a development device 4 is placed as a development unit. Next, a primary transfer roller 6 is placed, which is a roller-like primary transfer member as a primary transfer unit. Next, a static elimination lamp 9 is placed as a static elimination unit. Next, a cleaning device 5 is placed as a cleaning unit.

Further, an intermediate transfer belt 7, which is formed of an endless belt as an intermediate transfer member, is placed facing the photosensitive members 1Y, 1M, 1C, and 1K of the image forming units SY, SM, SC, and SK. The intermediate transfer belt 7 is stretched by a plurality of stretching rollers (supporting rollers) with a predetermined tension. A driving roller, which is one of the plurality of stretching rollers, is driven to rotate, thereby causing the intermediate transfer belt 7 to rotate (make a circling movement) in the direction of an arrow R2 in FIG. 1. On the inner peripheral surface of the intermediate transfer belt 7, the primary transfer roller 6 is placed in a position opposed to the photosensitive member 1. The primary transfer roller 6 is urged toward the photosensitive member 1 through the intermediate transfer belt 7 and forms a primary transfer unit (primary transfer nip) N1, at which the intermediate transfer belt 7 and the photosensitive member 1 come into contact (pressure contact) with each other. Further, on the outer peripheral surface of the intermediate transfer belt 7, a secondary transfer roller 8, which is a roller-like secondary transfer member as a secondary transfer unit, is placed in a position opposed to a secondary transfer opposing roller, which is one of the plurality of stretching rollers. The secondary transfer roller 8 is urged toward the secondary transfer opposing roller through the intermediate transfer belt 7 and forms a secondary transfer unit (secondary transfer nip) N2, at which the intermediate transfer belt 7 and the secondary transfer roller 8 come into contact (pressure contact) with each other.

Further, the image forming apparatus 100 includes a recording material storage device 10 and a fixing device 13.

When an image is formed, the surface of the rotating photosensitive member 1 is approximately uniformly charged to a predetermined potential having a predetermined polarity (the negative polarity in the present exemplary embodiment) by the charging device 2. The charged surface of the photosensitive member 1 is subjected to scanning exposure with laser light according to image information by the exposure device 3. Consequently, an electrostatic latent image (an electrostatic image) according to the image information is formed on the surface of the photosensitive member 1. The electrostatic image formed on the photosensitive member 1 is developed (visualized) as a toner image by the development device 4 using toner. Then, the toner image formed on the photosensitive member 1 by the exposure device 3 and the development device 4, which serve as a toner image forming unit, is electrostatically transferred (primarily transferred) at the primary transfer unit N1 onto the intermediate transfer belt 7 that is rotating, by the action of the primary transfer roller 6. In the present exemplary embodiment, when the primary transfer operation is performed, a primary transfer bias (a primary transfer voltage) (e.g., +1500 V) is applied to the primary transfer roller 6. The primary transfer bias is a direct-current (DC) voltage having a polarity (the positive polarity in the present exemplary embodiment) opposite to the charge polarity of the toner (a regular charge polarity) when the electrostatic image is developed. For example, when a full-color image is formed, the above operation is performed in the first, second, third, and fourth image forming units SY, SM, SC, and SK, and the toners of the respective colors are sequentially transferred, one on top of the other, onto the intermediate transfer belt 7.

Meanwhile, a recording material P is conveyed from the cassette 10, which serves as a recording material storage unit, to the secondary transfer unit N2 by a conveyance roller 11 serving as a conveyance unit. The toner image formed on the intermediate transfer belt 7 is electrostatically transferred (secondarily transferred) at the secondary transfer unit N2 onto the recording material P by the action of the secondary transfer roller 8. When the secondary transfer operation is performed, a predetermined secondary transfer bias (a secondary transfer voltage) is applied to the secondary transfer roller 8. The secondary transfer bias is a DC voltage having a polarity opposite to the charge polarity of the toner when the electrostatic image is developed. Then, the recording material P is separated from the intermediate transfer belt and conveyed to the fixing device 13. The recording material P is heated and pressurized by the fixing device 13, and the toner image on the recording material P is fused and solidified, thereby being fixed as an output image. The recording material P on which the toner image has been fixed is discharged as a product to the outside of the apparatus main body 110. After the toner image has been transferred onto the intermediate transfer belt 7, the photosensitive member 1 is irradiated with light by the static elimination lamp 9 to eliminate static. Then, the toner (primary transfer residual toner) remaining on the surface of the intermediate transfer belt 7 is removed by the cleaning device 5 and collected. Further, after the toner image has been secondarily transferred onto the recording material P, the toner (secondary transfer residual toner) remaining on the surface of the intermediate transfer belt 7 is removed by a belt cleaning device 12, which serves as an intermediate transfer member cleaning unit, and collected.

In the present exemplary embodiment, the photosensitive member 1 and the charging device 2, the development device 4, and the cleaning device 5, which serve as process units for acting on the photosensitive member 1, are integrated into a cartridge to form a process cartridge 200 as a unit attachable to and detachable from the apparatus main body 110. The details of the process cartridge 200 will be described later.

2. Configurations of Components of Image Forming Apparatus 2-1. Photosensitive Member In the present exemplary embodiment, the photosensitive member 1 includes a photosensitive layer formed of an organic photoconductor (OPC) having negative charge characteristics. Further, the photosensitive member 1 has a diameter of 30 mm and a length of 370 mm in the longitudinal direction (the direction of the rotational axis line). The photosensitive member 1 is driven to rotate in the direction of the arrow R1 in FIG. 1 at a process speed (peripheral velocity) of about 350 mm/sec. Further, the photosensitive member 1 has the layered structure of a general organic photosensitive member. Specifically, the photosensitive member 1 is formed by laminating an undercoat layer, an injection prevention layer, a charge generation layer, a charge transport layer, and a surface protection layer on an aluminum cylinder as a conductive base.

2-2. Charging Device

Figure 2:
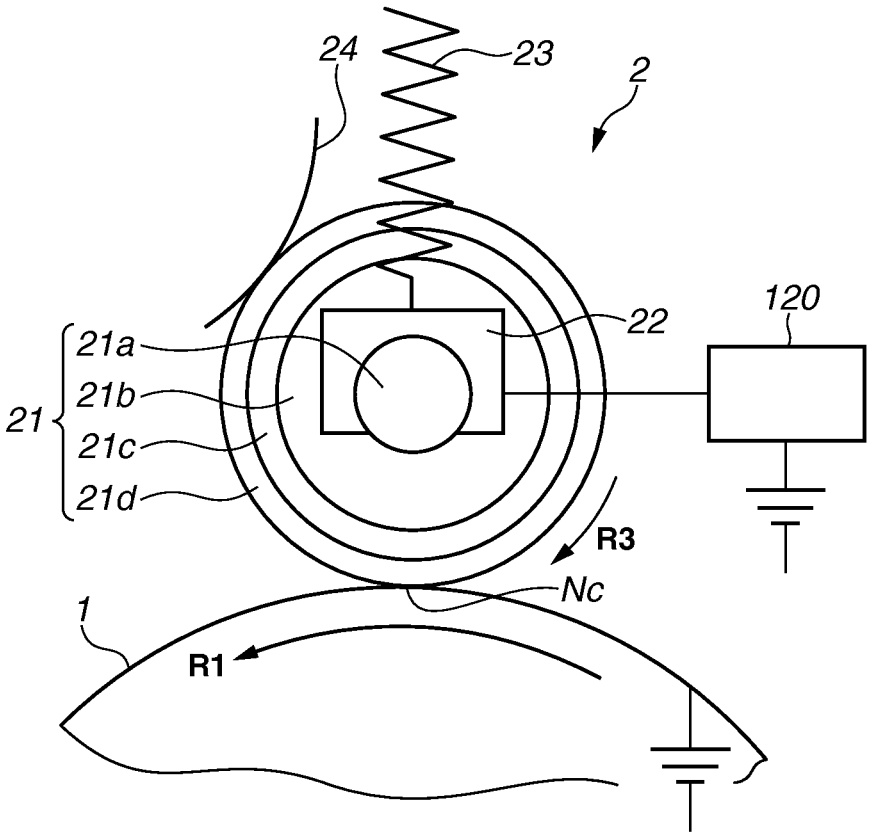
FIG. 2 is a schematic diagram illustrating a charging device.

FIG. 2 is a schematic diagram illustrating the charging device 2 according to the present exemplary embodiment. In the present exemplary embodiment, the charging device 2 includes a charging roller 21 as a charging member placed in contact with or in proximity to the outer peripheral surface (the surface) of the photosensitive member 1 to charge the photosensitive member 1. The charging roller 21 has a three-layer structure obtained by sequentially laminating a lower layer 21*b*, an intermediate layer 21*c*, and a surface layer 21*d* on the outer periphery of a core metal (supporting member) 21*a*. The core metal 21*a* is a stainless round bar having a diameter of 6 mm. The lower layer 21*b* is an electronically conductive layer made of foamed ethylene-propylene-diene rubber (EPDM) in which carbon is dispersed. The lower layer 21*b* has a specific gravity of 0.5 g/cm$^3$, a volume resistivity of $10^7$ to $10^9$ Ω·cm and a layer thickness of about 3.5 mm. The intermediate layer 21*c* is made of nitrile rubber (NBR) in which carbon is dispersed. The intermediate layer 21*c* has a volume resistivity of $10^2$ to $10^5$ Ω·cm and a layer thickness of about 500 μm. The surface layer 21*d* is an ion conductive layer formed by dispersing tin oxide and carbon in an alcohol-soluble nylon resin that is a fluorine compound. The surface layer 21*d* has a volume resistivity of $10^7$ to $10^{10}$ Ω·cm a surface roughness (a 10-point average surface roughness Rz defined by Japanese Industrial Standards (JIS)) of 1.5 μm, and a layer thickness of about 5 μm. In the present exemplary embodiment, the charging roller 21 has a length of 330 mm in the longitudinal direction (the direction of the rotational axis line) and a diameter of 14 mm.

Further, the charging device 2 includes bearing members 22, which rotatably hold both longitudinal end portions of the core metal 21*a* of the charging roller 21. Further, the charging device 2 includes pressing springs 23 as urging units for urging (pressing) the charging roller 21 toward the photosensitive member 1 through the bearings 22 at both longitudinal end portions of the charging roller 21. The charging roller 21 is brought into pressure contact with the surface of the photosensitive member 1 with a predetermined pressing force by the pressing springs 23. Then, the charging roller 21 is driven to rotate in the direction of an arrow R3 in FIG. 2 by the rotation of the photosensitive member 1. The pressure contact portion between the photosensitive member 1 and the charging roller 21 is a charging nip Nc. Further, in the present exemplary embodiment, the charging device 2 includes a charging roller cleaning member 24 as a cleaning unit for cleaning the charging roller 21. The charging roller cleaning member 24 can be a roller-like or fixed brushing member, a roller-like or fixed sponge member, or a sheet-like member that is placed in contact with the charging roller 21.

The charging roller 21 comes into contact with the surface of the photosensitive member 1, which is a member to be charged, and a predetermined charging bias (charging voltage) is applied to the charging roller 21 by a charging power source (high-voltage power source) 120 provided in the apparatus main body 110. Then, the surface of the photosensitive member 1 is charged by discharge that occurs in a minute gap between the charging roller 21 and the surface of the photosensitive member 1. The minute gap (the discharge gap) where this charging process is performed is one or both of wedge-shaped (as viewed along the rotational axis line of the photosensitive member 1) spaces upstream and downstream of the charging nip Nc in the moving direction of the surface of the photosensitive member 1. If the charging member is placed in proximity to the photosensitive member 1, which is the member to be charged, the charging process is performed also on the closest portion as a discharge area in a case where the charging member and the photosensitive member 1 are disposed close to each other.

In the present exemplary embodiment, when the charging operation is performed, an oscillation voltage obtained by superimposing a direct-current voltage (DC voltage) on an alternating-current voltage (AC voltage) is applied as a charging bias to the charging roller 21 by the charging power source 120. Specifically, as an example, an oscillation voltage obtained by superimposing a DC voltage of −850 V on an AC voltage having a peak-to-peak voltage of 1900 Vpp and a frequency of 2.5 kHz is applied. Consequently, the photosensitive member 1 is approximately uniformly charged to a charge potential (a dark potential) of −800 V.

Figure 3:
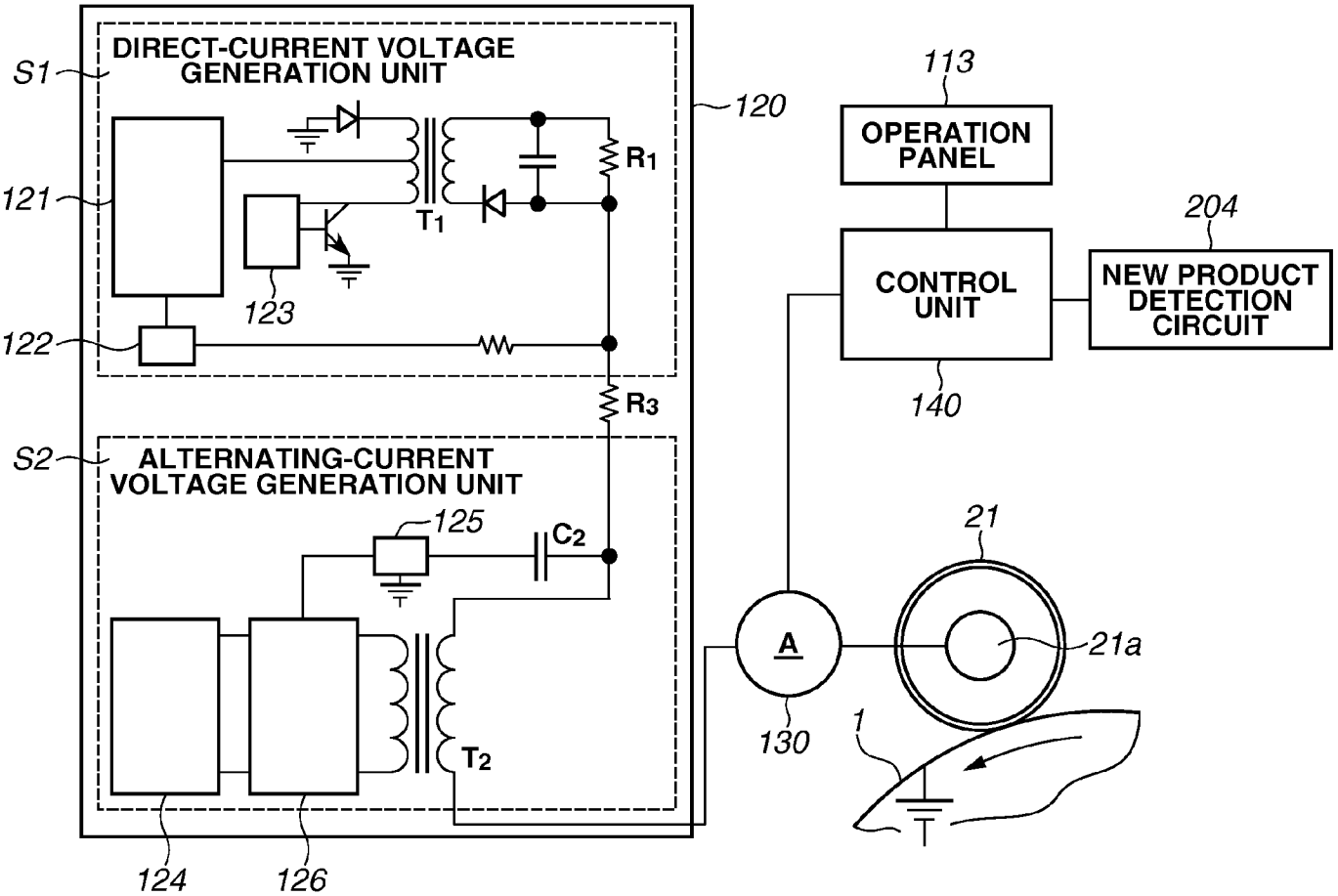
FIG. 3 is a block circuit diagram illustrating a voltage application system for applying a voltage to the charging device.

FIG. 3 is a schematic circuit diagram illustrating a charging bias application system for applying a charging bias to the charging roller 21 according to the present exemplary embodiment. The charging power source 120, which is a voltage application unit for applying a voltage to the charging roller 21, includes a direct-current voltage generation unit (DC power source) S1 and an alternating-current voltage generation unit (AC power source) S2. A DC voltage is output as a constant voltage from the DC power source S1, which includes a transformer T1. In the DC power source S1, a DC high-voltage control circuit (comparator) 121 detects a DC voltage via a resistance R1 by a voltage detection circuit 122 and stabilizes the DC voltage output based on output information of the detected DC voltage. A control circuit driving signal input unit 123 inputs a driving signal to the transformer T1. Further, an AC voltage is output with a constant current from the AC power source S2, which includes a transformer T2. An AC high-voltage control circuit 124 detects an alternating current (AC current) via a capacitor C2 by a current detection circuit 125 and controls the gain of an amplification circuit 126 based on output information of the detected AC current. Further, the output of the DC power source S1 and the output of the AC power source S2 are superimposed on each other via a resistance R3. Consequently, an oscillation voltage (a charging bias Vdc+Vac) obtained by superimposing a predetermined DC voltage on an AC voltage having a predetermined peak-to-peak voltage and a predetermined frequency is applied to the charging roller 21 via the core metal 21*a* by the charging power source 120.

Further, a current value measurement circuit (hereinafter also referred to simply as "measurement circuit") 130, which serves as a current detection unit for measuring the currents flowing between the charging roller 21 and the photosensitive member 1, that is, the direct-current value (DC current value) and the alternating-current value (AC current value) of the currents flowing to the charging roller 21 via the photosensitive member 1, is connected to the charging power source 120 and the charging roller 21. The measurement circuit 130 inputs information about the measured current values to a control unit 140, which serves as a control unit provided in the apparatus main body 110. The information about the current values is used for attachment state detection control performed by the control unit 140.

Further, in the present exemplary embodiment, the control unit 140 performs overall control of the operations of the components of the image forming apparatus 100, including the image forming operation for forming an image on the recording material P and outputting the recording material P. The control unit 140 can include a conventional computer control device that has a calculation function and a storage function and can be programmed.

2-3. Exposure Device

In the present exemplary embodiment, the exposure device 3 is a laser beam scanning exposure device using a semiconductor laser source and a polygon mirror optical system. The potential of an image portion on the surface of the photosensitive member 1 charged by the charging device 2 is exposed by the exposure device 3, thereby changing to about −300 V.

2-4. Development Device

In the present exemplary embodiment, the development device uses a two-component developer as a developer. The development device 4 includes a development container 41, in which the two-component developer is stored. The two-component developer is a mixture of mainly non-magnetic toner particles (toner) and magnetic carrier particles (carrier). In the present exemplary embodiment, the two-component developer has a toner concentration (TD ratio) of 8%, which is obtained by mixing toner with carrier in a weight ratio of about 8:92.

The development device 4 includes a developing sleeve 42 as a developer bearing member in an opening portion of the development container 41 opposed to the photosensitive member 1. The developing sleeve 42 is placed facing the photosensitive member 1 while maintaining a distance of closest approach of 200 μm from the photosensitive member 1. A portion where the photosensitive member 1 and the developing sleeve 42 are opposed to each other, serves as a development unit. The developing sleeve 42 is driven to rotate by a driving motor (not illustrated) serving as a driving unit provided in the apparatus main body 110, such that the moving direction of the surface of the developing sleeve 42 is a forward direction relative to the moving direction of the surface of the photosensitive member 1 in the development unit. In a hollow portion of the developing sleeve 42, a magnetic roller 43 is placed as a magnetic field generation unit. The two-component developer is borne on the surface of the developing sleeve 42 under the magnetic force of the magnetic roller 43. The layer of the developer borne on the surface of the developing sleeve 42 is regulated to a predetermined thickness by a developing blade 44, which serves as a developer regulation unit. Then, the two-component developer is conveyed to the development unit with the rotation of the developing sleeve 42 and forms a magnetic brush in proximity to or in contact with the surface of the photosensitive member 1 under the magnetic force of the magnetic roller 43. Further, a predetermined development bias (development voltage) is applied to the developing sleeve 42 by a development power source (not illustrated) provided in the apparatus main body 110. In the present exemplary embodiment, when the development operation is performed, an oscillation voltage obtained by superimposing a DC voltage on an AC voltage is applied as a development bias to the developing sleeve 42. Specifically, if the charge potential (the dark potential) of the photosensitive member 1 is −800 V, an oscillation voltage obtained by superimposing a DC voltage of −620 V on an AC voltage having a peak-to-peak voltage of 1300 Vpp and a frequency of 10 kHz is applied.

By the electric field formed by the development bias applied to the developing sleeve 42, the toner in the two-component developer is selectively applied onto an image portion of an electrostatic image on the photosensitive member 1. Consequently, the electrostatic image on the photosensitive member 1 is developed as a toner image. The amount of charge of the toner formed on the photosensitive member 1 is about 40 μC/g. The developer on the developing sleeve 42 having passed through the development unit is returned to a developer storage portion in the development container 41 with the rotation of the developing sleeve 42.

2-5. Cleaning Device

In the present exemplary embodiment, the cleaning device 5 includes a cleaning blade 51 as a cleaning member and a waste toner container 52. The cleaning blade 51 abuts the surface of the photosensitive member 1. The cleaning device 5 scrapes the primary transfer residual toner, using the cleaning blade 51, from the surface of the photosensitive member 1 that is rotating. Then, the cleaning device 5 collects the primary transfer residual toner in the waste toner container 52. The cleaning device 5 is not limited to a blade cleaning method including the cleaning blade 51, but may include a fur brush as a cleaning member.

3. Process Cartridge

Figure 4:
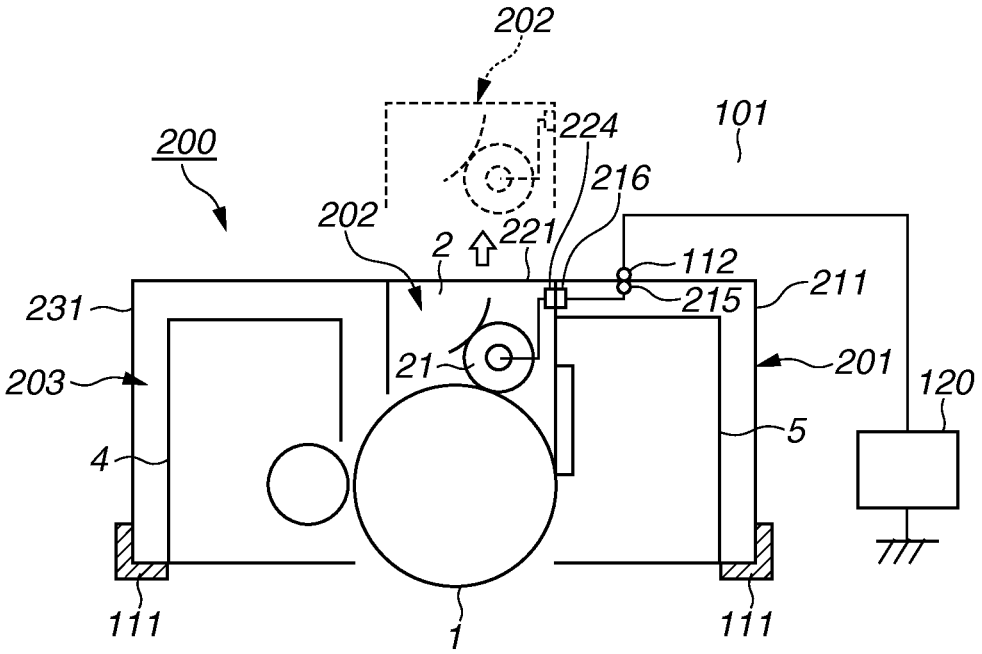
FIG. 4 is a schematic cross-sectional view of a process cartridge.

FIG. 4 is a schematic cross-sectional view of a process cartridge according to the present exemplary embodiment. In the present exemplary embodiment, the process cartridge 200 is formed by combining a cleaning unit 201, a charging unit 202, and a development unit 203 in an integrated manner. The cleaning unit 201 is formed by integrating the photosensitive member 1 and the cleaning device 5 using a cleaning frame member 211 as a supporting frame member. The charging unit 202 is formed by integrating the charging device 2 using a charging frame member 221 as a supporting frame member. Further, the development unit 203 is formed by integrating the development device 4 using a development frame member 231 as a supporting frame member. Then, in the present exemplary embodiment, the entirety of the process cartridge 200 is attachable to and detachable from the apparatus main body 110, and the charging unit 202 including at least the charging member is individually attachable to and detachable from the process cartridge 200. Particularly, in the present exemplary embodiment, as will be described in detail later, the charging unit 202 is detachably combined with the cleaning unit 201. Further, in the present exemplary embodiment, the development unit 203 is also detachably combined with the cleaning unit 201.

The process cartridge 200 is inserted into the apparatus main body 110 and attached in a predetermined manner to an attachment portion 111, which serves as an attachment unit provided in a predetermined position in the apparatus main body 110. Further, conversely, the process cartridge 200 is detached from the attachment portion 111 of the apparatus main body 110 and pulled out of the apparatus main body 110.

As described above, the process cartridge 200 is configured to be attachable to and detachable from the apparatus main body 110. This can facilitate the maintenance of the process cartridge 200 and the replacement of consumable items, and therefore can facilitate the maintenance of the performance of the product. That is, the long-term use of the image forming apparatus 100 may lead to wear and tear on various components and therefore reduce the image quality. An operator such as a user or a serviceman, however, detaches the process cartridge 200 having come to the end of its life to replace the process cartridge 200 with a new process cartridge 200. Thus, it is possible to easily maintain the process cartridge 200 and replace consumable items, and therefore maintain a prescribed function of the image forming apparatus 100.

Further, the charging unit 202 is configured to be individually attachable to and detachable from the process cartridge 200. Thus, for example, if the charging roller 21 has entered the state where the charging roller 21 should be replaced due to stains and scratches, it is possible to individually replace only the charging unit 202, where appropriate. Further, it is also possible to detach the charging roller 21 from the process cartridge 200, clean the charging roller 21, and attach the charging roller 21 to the process cartridge 200 again. Thus, it is possible to maintain a prescribed function of the image forming apparatus 100 without wasting the other components of the process cartridge 200 that can still be thoroughly used.

Figure 5:
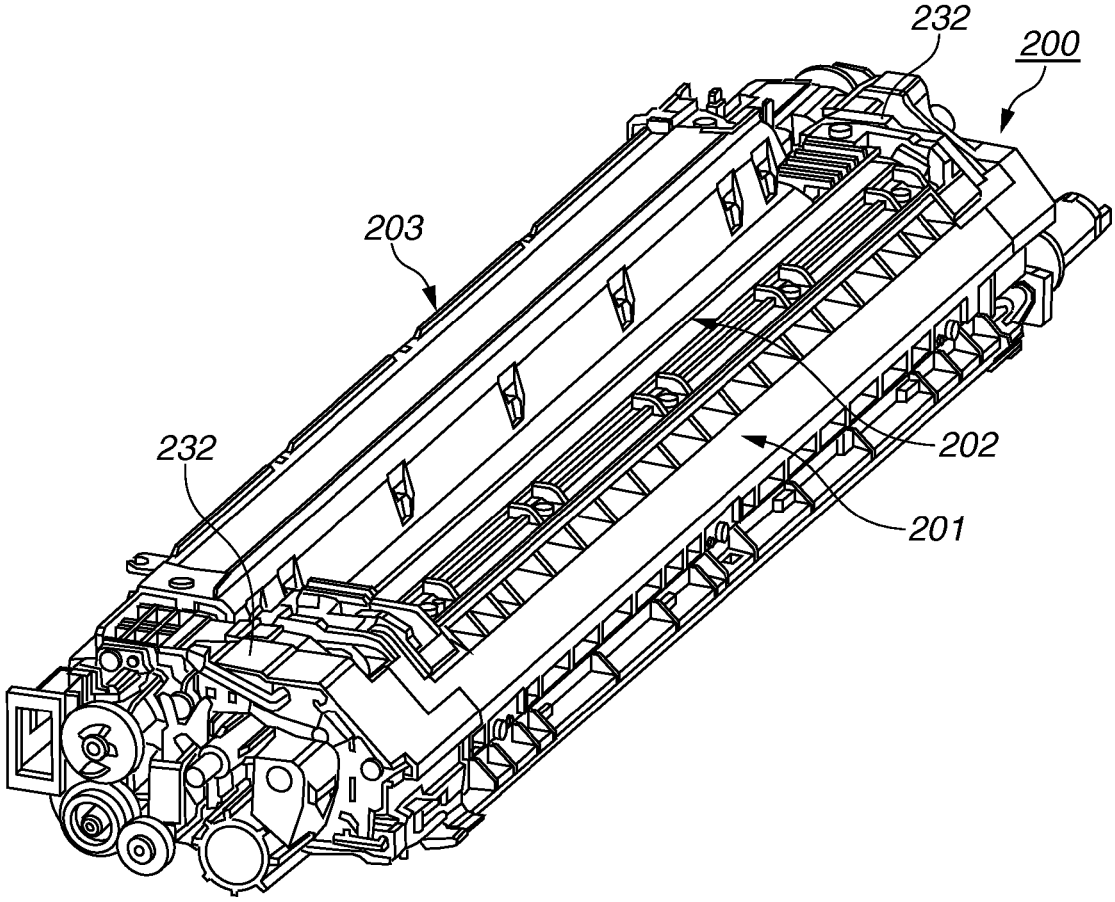
FIG. 5 is a perspective view of the process cartridge.
Figure 6:
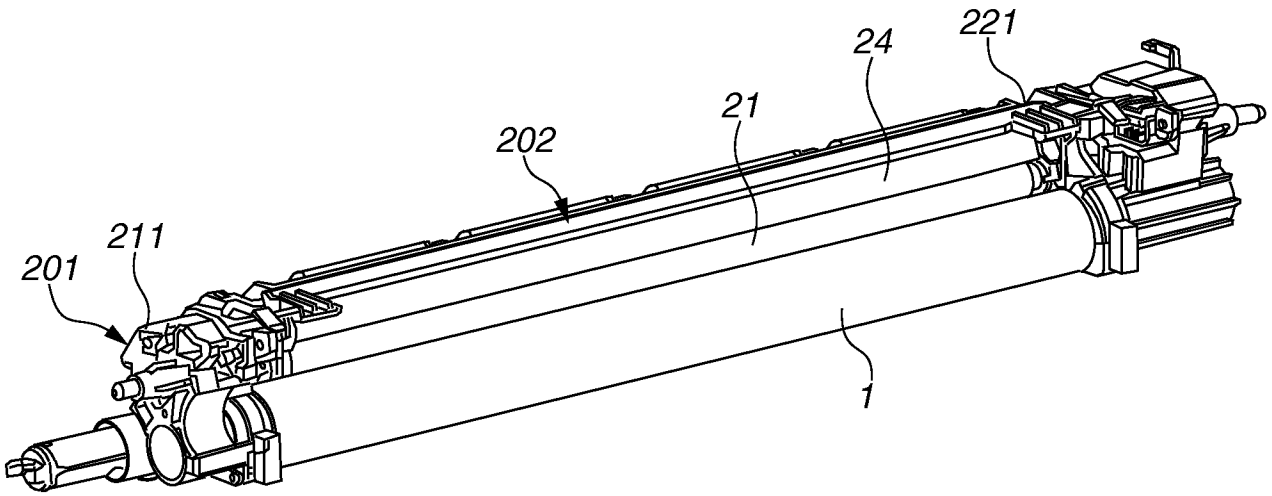
FIG. 6 is a perspective view of a charging unit and a cleaning unit.
Figure 7:
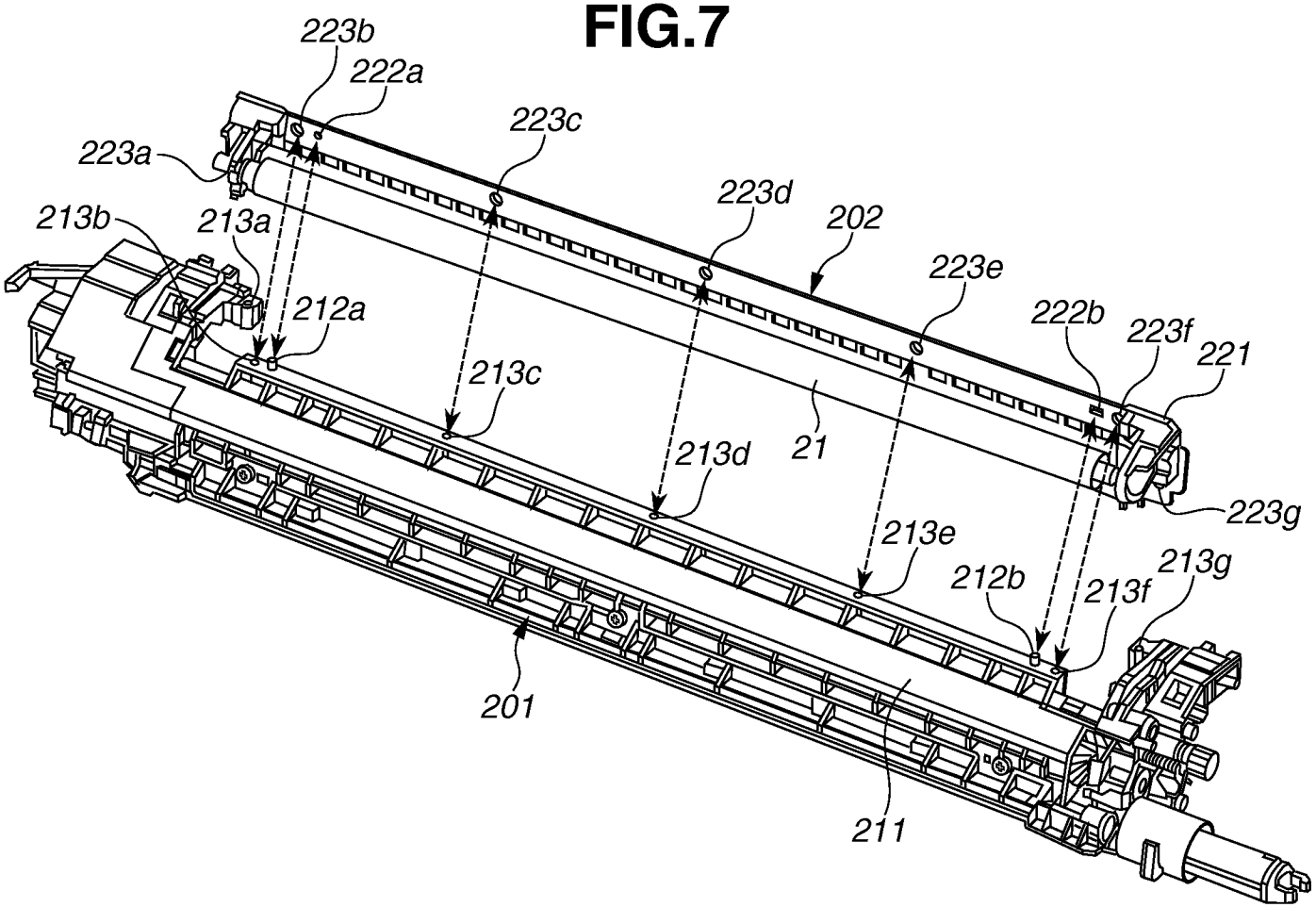
FIG. 7 is an exploded perspective view of the charging unit and the cleaning unit.

FIG. 5 is a perspective view of the external appearance of the process cartridge 200 according to the present exemplary embodiment. FIG. 5 represents the external appearance of the cleaning unit 201 on the near side. FIG. 6 is a perspective view of the cleaning unit 201 and the charging unit 202 in the process cartridge 200 according to the present exemplary embodiment. FIG. 7 is an exploded perspective view of the cleaning unit 201 and the charging unit 202. FIG. 6 represents the photosensitive member 1 in the cleaning unit 201 on the near side. FIG. 7 represents the external appearance of the cleaning unit 201 on the near side.

In the present exemplary embodiment, as illustrated in FIG. 5, the development unit 203 is fit to the cleaning unit 201. Further, the development unit 203 and the cleaning unit 201 are combined together by combination arms 232 in an integrated manner.

Further, in the present exemplary embodiment, as illustrated in FIGS. 6 and 7, the charging unit 202 is attachable to and detachable from the cleaning unit 201 with the components of the charging device 2, such as the charging roller 21 and the charging roller cleaning member 24, held by the charging frame member 221.

Further, in the charging frame member 221 of the charging unit 202, first and second positioning holes 222*a* and 222*b* are formed. The first positioning hole 222*a* is a round hole, and the second positioning hole 222*b* is an elongated hole. On the other hand, in the cleaning frame member 211 of the cleaning unit 201, first and second positioning projections 212*a* and 212*b* are formed. Further, in the charging frame member 221, fixing holes (screw holes) 223*a* to 223*g* are formed. In the cleaning frame member 211, fixing holes (screw holes) 213*a* to 213*g* are formed. The charging unit 202 is fit to the cleaning unit 201 using the first and second positioning holes 222*a* and 222*b* and the first and second positioning projections 212*a* and 212*b* as references. Then, the charging unit 202 is fixed to the cleaning unit 201 through the screw holes 223*a* to 223*g* and 213*a* to 213*g* using screws (not illustrated) as fixing methods. Dashed arrows in FIG. 7 indicate corresponding parts when the charging unit 202 and the cleaning unit 201 are joined together.

It is desirable that the charging unit 202 should be held by the cleaning unit 201 at at least three or more points in the longitudinal direction (the direction of the rotational axis line) of the charging roller 21. In the present exemplary embodiment, the charging unit 202 is fixed to the cleaning unit 201 using screws at seven points in the longitudinal direction of the charging roller 21. Thus, it is possible to maintain a close contact state between the photosensitive member 1 and the charging roller 21 with more uniform pressure distribution. That is, it is possible to uniformize the discharge gap between the charging roller 21 and the surface of the photosensitive member 1 in the longitudinal direction of the charging roller 21. Thus, it is possible to uniformize the surface potential of the photosensitive member 1 more excellently.

Figure 8:
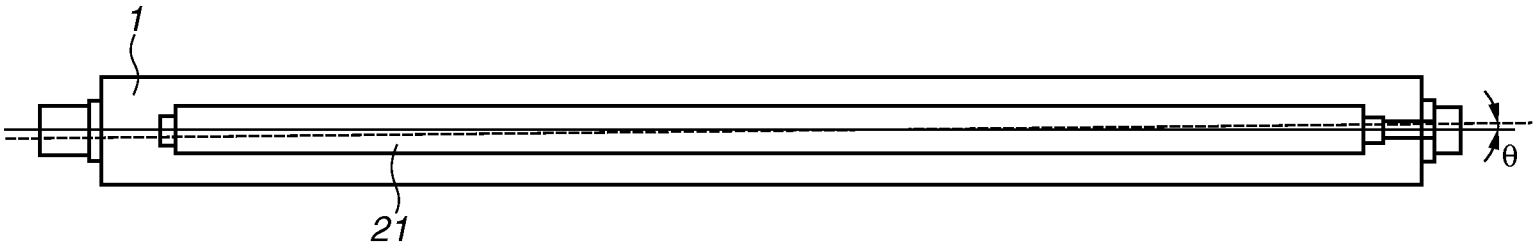
FIG. 8 is a side view illustrating the installation relationship between a charging roller and a photosensitive member.

Further, in the present exemplary embodiment, as illustrated in FIG. 8, the configuration is such that when the charging unit 202 has been attached to the process cartridge 200 by combining the cleaning unit 201 and the charging unit 202 together, the direction of the rotational axis line of the charging roller 21 intersects the direction of the rotational axis line of the photosensitive member 1 at an angle of intersection θ as viewed in the direction in which the charging roller 21 presses the photosensitive member 1. That is, in the present exemplary embodiment, the direction of the rotational axis line of the charging roller 21 and the direction of the rotational axis line of the photosensitive member 1 are not placed parallel to each other. Thus, it is possible to uniformize the surface potential of the photosensitive member 1 more excellently. In FIG. 8, a solid line represents the longitudinal base line (the rotational axis line) of the core metal 21*a* of the charging roller 21, and a dashed line represents the longitudinal base line (the rotational axis line) of the photosensitive member 1. In the present exemplary embodiment, the angle of intersection θ is 3°. This can improve the convergence of the surface potential of the photosensitive member 1 provided by the charging roller 21. The present invention, however, is not limited to the configuration where the above angle of intersection is set. Alternatively, the direction of the rotational axis line of the photosensitive member 1 and the direction of the rotational axis line of the charging roller 21 may be approximately parallel to each other. Further, even if the above angle of intersection is set, the angle may be equal to or greater than the angle according to the present exemplary embodiment, or may be the angle less than or equal to the angle according to the present exemplary embodiment. Normally, it is desirable that the angle of intersection θ should be 10° or less.

4. Power Feeding Configuration

Next, a description is given of a power feeding configuration for feeding power to the process cartridge 200 according to the present exemplary embodiment. In the present exemplary embodiment, a description is given, particularly, of a power feeding configuration for feeding power to the charging device 2, which serves as a process unit for acting on the photosensitive member 1 provided in the process cartridge 200.

Figure 9:
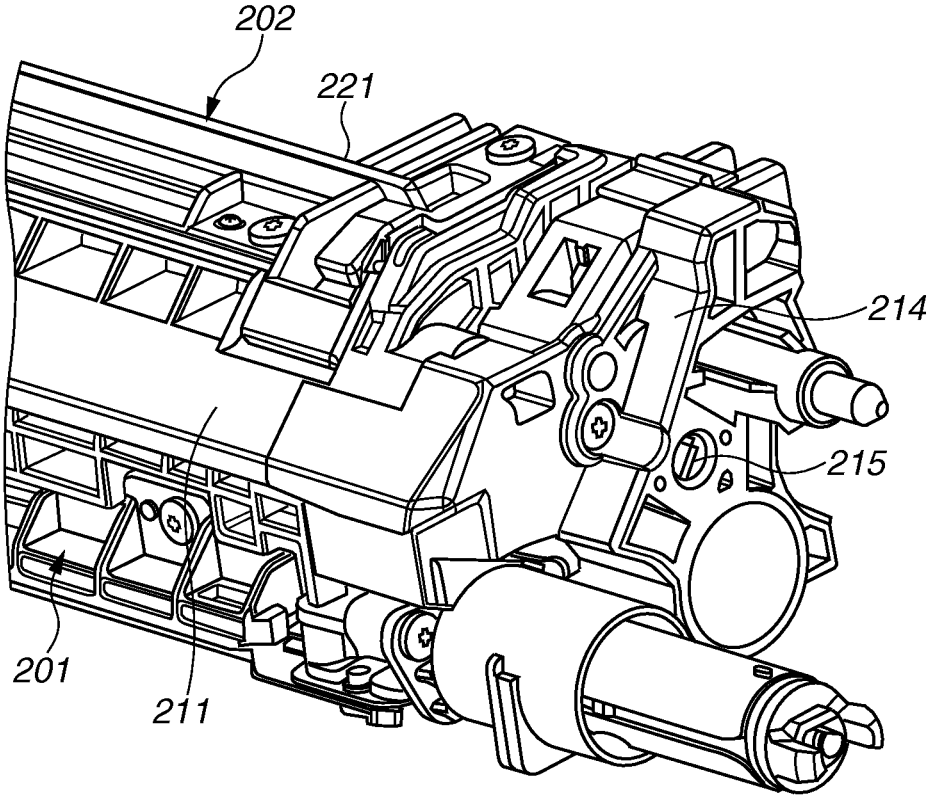
FIG. 9 is a perspective view of end portions, on one side, of the charging unit and the cleaning unit.
Figure 10:
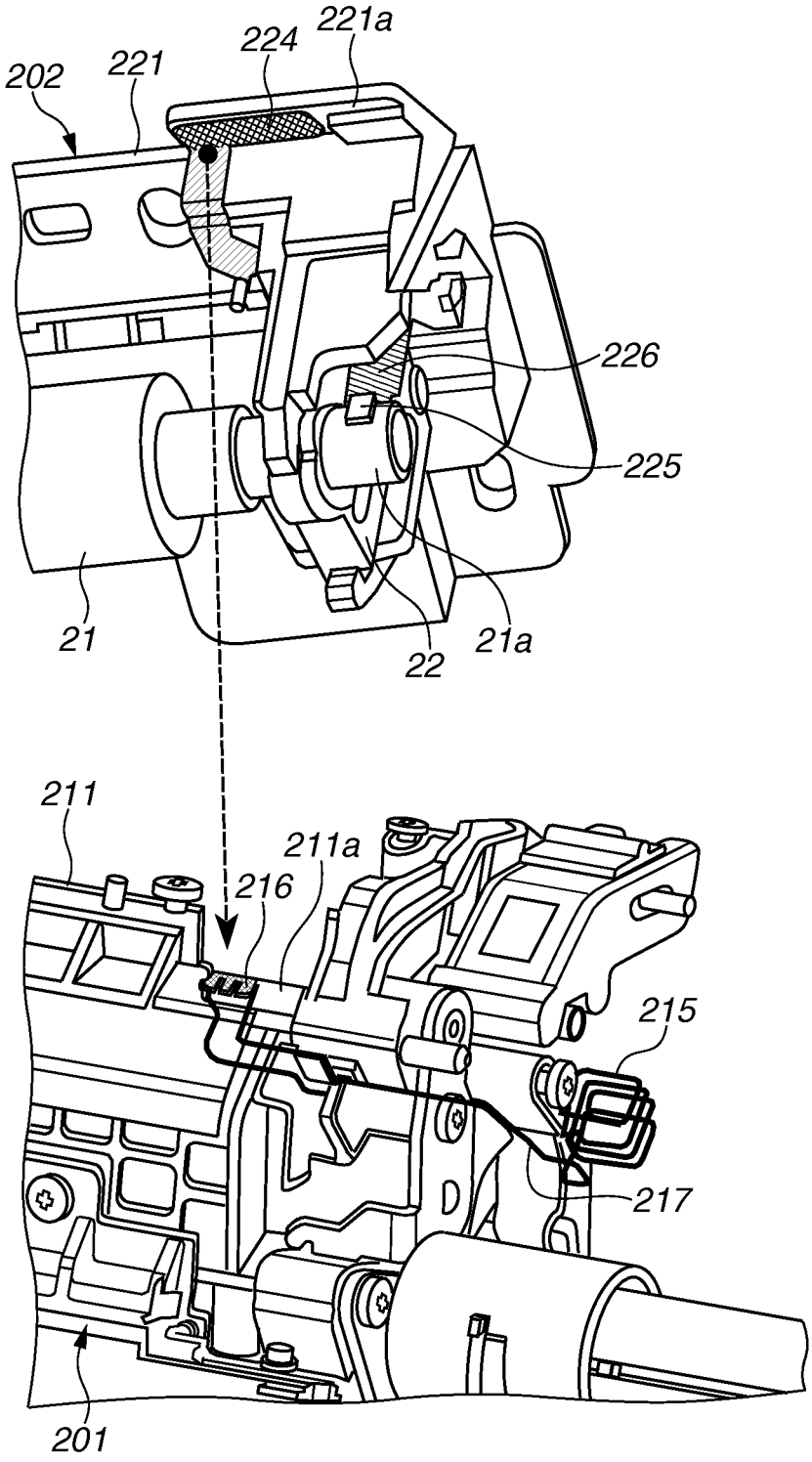
FIG. 10 is an exploded perspective view of the end portions, on the same side, of the charging unit and the cleaning unit.

FIG. 9 is an enlarged perspective view of the vicinity of longitudinal end portions, on one side (corresponding to the right side of FIG. 7), of the cleaning unit 201 and the charging unit 202 in the process cartridge 200 according to the present exemplary embodiment. FIG. 10 is an enlarged exploded perspective view of the vicinity of the same end portions. FIG. 9 illustrates the state where an end portion cover 214 is attached to the longitudinal end portion of the cleaning unit 201. FIG. 10 illustrates the state where the end portion cover 214 has been detached.

As illustrated in FIG. 9, in the cleaning frame member 211 of the cleaning unit 201, a cartridge/main body contact portion 215 is provided to be exposed through the end portion cover 214. When the process cartridge 200 has been attached to the apparatus main body 110, the cartridge/main body contact portion 215 comes into contact with and becomes electrically connected to a main body side contact portion 112 provided in the apparatus main body 110 (FIG. 4). Further, the main body side contact portion 112 is electrically connected to the charging power source 120 provided in the apparatus main body 110. The cartridge/main body contact portion 215 receives via the main body side contact portion 112 a charging bias applied by the charging power source 120 provided in the apparatus main body 110.

As illustrated in FIG. 10, the cleaning frame member 211 of the cleaning unit 201 includes a first inter-unit contact portion 216 located in a first contact clamping portion 211*a*, which is a part of a portion to be joined with the charging frame member 221 of the charging unit 202. Further, the cleaning frame member 211 of the cleaning unit 201 includes a first lead portion 217, of which one end portion is connected to the cartridge/main body contact portion 215 and the other end portion is connected to the first inter-unit contact portion 216. In the present exemplary embodiment, an electrode member integrated with the cartridge/main body contact portion 215 is extended as the first lead portion 217 to the first contact clamping portion 211*a* and connected to the first inter-unit contact portion 216.

On the other hand, as illustrated in FIG. 10, the charging frame member 221 of the charging unit 202 includes a second inter-unit contact portion 224 located in a second contact clamping portion 221*a*, which is a part of a portion to be joined with the cleaning frame member 211 of the cleaning unit 201. Further, the charging frame member 221 of the charging unit 202 includes an application contact portion 225 in contact with the core metal 21*a* of the charging roller 21. The application contact portion 225 is configured to always apply a charging bias by maintaining a predetermined pressure contact state with the core metal 21*a* even if the charging roller 21 rotates. Further, the charging frame member 221 of the charging unit 202 includes a second lead portion 226, of which one end portion is connected to the second inter-unit contact portion 224 and the other end portion is connected to the application contact portion 225. In the present exemplary embodiment, an electrode member integrated with the second inter-unit contact portion 224 is extended as the second lead portion 226 from the second contact clamping portion 221*a* to the vicinity of the end portion of the core metal 21*a* of the charging roller 21 and connected to the application contact portion 225.

Then, the charging unit 202 becomes combined with the cleaning unit 201 as described above, whereby the first and second inter-unit contact portions 216 and 224 come into contact with and become electrically connected to each other. At this time, in the present exemplary embodiment, the first and second inter-unit contact portions 216 and 224 are clamped by the first and second contact clamping portions 211*a* and 221*a*. This makes it unlikely that a contact point failure occurs.

5. New Product Detection Unit

Figure 11:
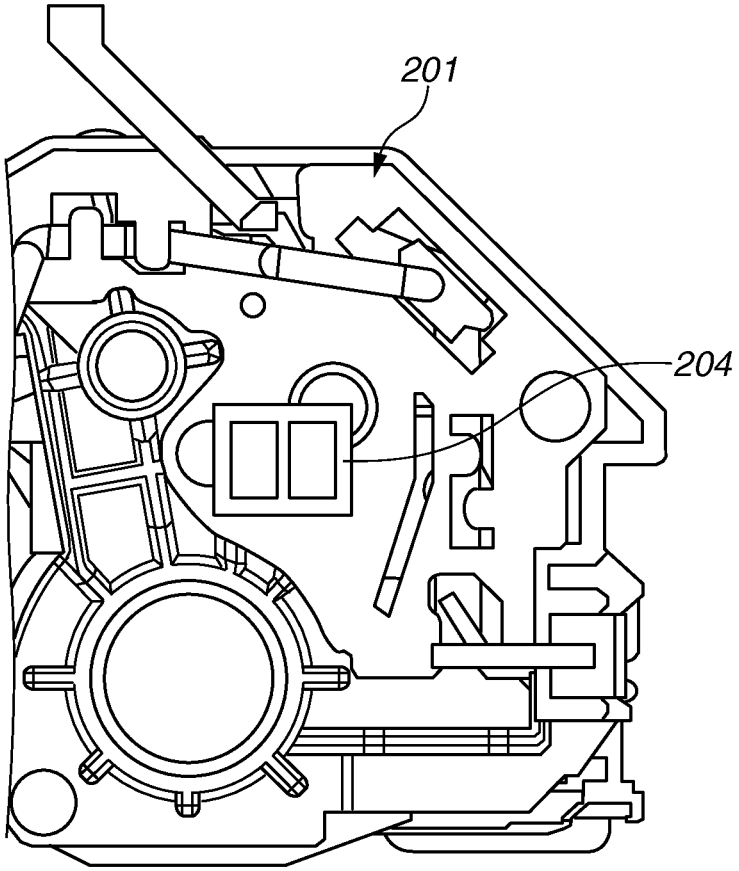
FIG. 11 is a front view of the cleaning unit on one end.

In the present exemplary embodiment, the cleaning unit 201 has a new product detection unit for determining whether the process cartridge 200 is new or used. FIG. 11 is a front view of the cleaning unit 201 in the longitudinal direction. In the present exemplary embodiment, on the side surface of the cleaning unit 201 on the near side in FIG. 11 (corresponding to the left side of FIG. 7), a new product detection circuit 204 is provided as a new product detection unit. The new product detection circuit 204 includes an integrated circuit (IC) chip and a built-in fuse. When the process cartridge 200 has been attached to the apparatus main body 110, the new product detection circuit 204 comes into contact with and becomes electrically connected to a main body side detection circuit contact (not illustrated) provided in the apparatus main body 110. Then, when the apparatus main body 110 has been turned on, a current is applied via the main body side detection circuit contact, thereby disconnecting the fuse. The process cartridge 200 in which the fuse has been disconnected is always determined as being used, even if the operation of attaching or detaching the process cartridge 200 to or from the apparatus main body 110 is repeated after the disconnection. Information from the new product detection circuit 204 indicating whether the process cartridge 200 is new or used can be used as, for example, one of criteria to determine whether it is necessary to perform attachment state detection control.

The new product detection unit is not limited to being provided in the cleaning unit 201. For example, a similar new product detection unit can be provided also in the charging unit 202 in addition to the cleaning unit 201. Thus, it is possible to determine whether the charging unit 202 is new or used, and confirm the operation of attaching or detaching the charging unit 202. For example, the new product detection unit can be used as, for example, one of criteria to determine whether it is necessary to perform attachment state detection control. For example, if the new product detection unit provided in the charging unit 202 indicates that the charging unit 202 is new, it is possible to allow attachment state detection control.

6. Attachment State Detection Control

Next, a description is given of attachment state detection control for detecting the state of attachment (the state of assembly) of the charging unit 202 to the cleaning unit 201 according to the present exemplary embodiment.

6-1. Processing on Operator Side

Figure 12:
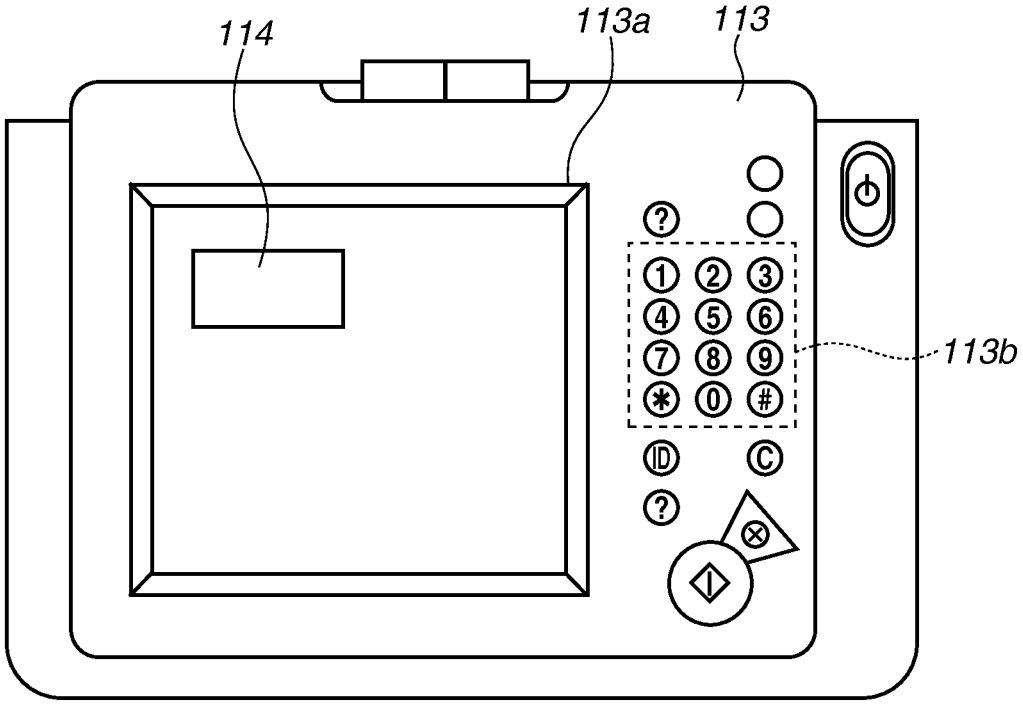
FIG. 12 is a plan view of an operation panel.

FIG. 12 illustrates an operation panel (operation unit) 113 as an operation unit provided in the apparatus main body 110 of the image forming apparatus 100 according to the present exemplary embodiment. The operation panel 113 includes a display screen 113*a* and a mechanical key input unit 113*b*. The display screen 113*a* is configured as a touch panel display. The display screen 113*a* functions as a display unit for displaying information and also functions as an input unit for inputting information using displayed software keys. In the present exemplary embodiment, an execute button 114 on the operation panel 113 included in the apparatus main body 110 is provided as an input unit (a selection unit) for inputting a signal for causing the control unit 140 to perform the attachment state detection control, thereby giving an instruction to the image forming apparatus 100.

Figure 13:
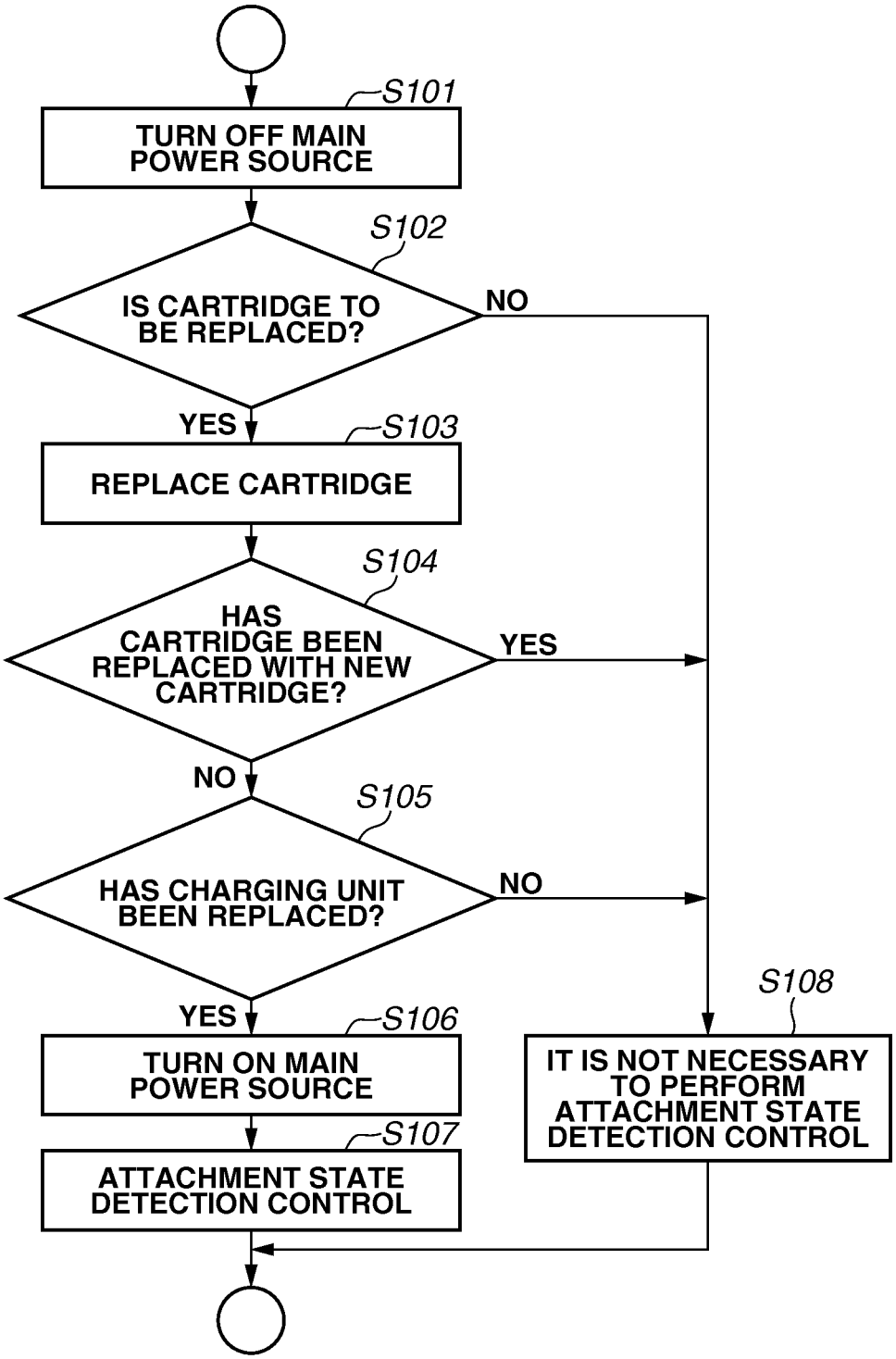
FIG. 13 is a flow diagram illustrating the work of an operator when attachment state detection control is performed.

First, with reference to FIG. 13, a description is given of the flow of the work of the operator such as a user or a serviceman when the attachment state detection control is performed.

Step S101: The operator turns off the main power source of the apparatus main body 110 in preparation for the replacement of the process cartridge 200.

Step S102: The operator determines whether the process cartridge 200 is to be replaced or a part other than the process cartridge 200 (the charging unit 202 in the present exemplary embodiment) is to be replaced.

Step S103: The operator replaces the process cartridge 200.

Step S104: The operator determines whether the process cartridge 200 has been replaced with a new process cartridge 200. If the process cartridge 200 has been replaced with a new process cartridge 200 (Yes in step S104), the processing proceeds to step S108. If the process cartridge 200 has not been replaced with a new process cartridge 200 (No in step S104), the processing proceeds to step S105.

Step S105: The operator determines whether only the charging unit 202 has been replaced. If only the charging unit 202 has been replaced (Yes in step S105), the processing proceeds to step S106. If the charging unit 202 has not been replaced (No in step S105), the processing proceeds to step S108.

Step S106: The operator turns on the main power source of the apparatus main body 110.

Step S107: the operator operates the execute button 114 on the operation panel 113 by, for example, pressing (touching) the execute button 114, thereby causing the control unit 140 to perform the attachment state detection control.

Step S108: The operator transitions to regular work because it is not necessary to perform the attachment state detection control.

6-2. Processing on Image Forming Apparatus Side

Figure 14:
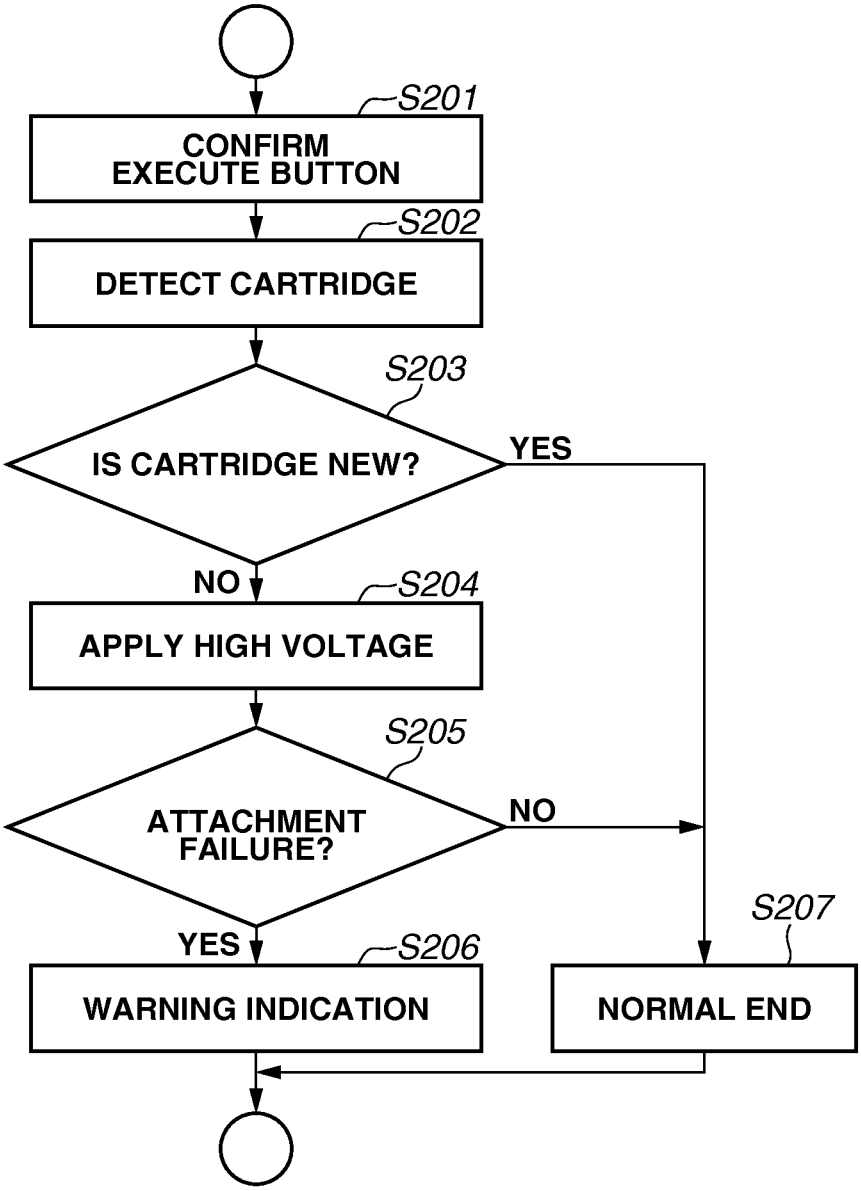
FIG. 14 is a flow diagram illustrating the processing of a control unit when the attachment state detection control is performed.

Next, with reference to FIG. 14, a description is given of the flow of the processing of the apparatus main body 110 when the attachment state detection control is performed. The processing is performed by the control unit 140 provided in the apparatus main body 110.

Step S201: The control unit 140 confirms that the operator has operated the execute button 114 on the operation panel 113.

Step S202: The control unit 140 detects the state of the process cartridge 200 using the new product detection circuit 204.

Step S203: The control unit 140 determines whether the process cartridge 200 has been replaced with a new process cartridge 200. If the process cartridge 200 has been replaced with a new process cartridge 200 (Yes in step S203), the processing proceeds to step S207. If the process cartridge 200 has not been replaced with a new process cartridge 200 (No in step S203), the processing proceeds to step S204. At this time, if the fuse of the new product detection circuit 204 is not in a disconnected state, the control unit 140 determines that the process cartridge 200 is new. If the fuse is in a disconnected state, the control unit 140 determines that the process cartridge 200 is used.

Step S204: The control unit 140 applies a high voltage to the charging device 2 under the conditions (settings) for performing the attachment state detection control.

Step S205: Based on the detection result of the measurement circuit 130, the control unit 140 determines whether a failure has occurred in the attachment of the charging unit 202 to the cleaning unit 201 in the process cartridge 200 currently attached to the apparatus main body 110. If it has been determined that an attachment failure has occurred (Yes in step S205), the processing proceeds to step S206. If an attachment failure has not occurred (No in step S205), the processing proceeds to step S207.

Step S206: The control unit 140 gives a warning indication (an error indication) on the operation panel 113 to indicate that an attachment failure has occurred, thereby prompting the operator to re-examine the state of attachment of the replaced part (the charging unit 202 in the present exemplary embodiment).

Step S207: Since an attachment failure has not occurred, the control unit 107 immediately transitions to regular control.

The attachment state detection control is performed when the operator has attached or detached a part (the charging unit 202 in the present exemplary embodiment) to replace or clean the part, but is not performed while an image is normally formed. That is, the attachment state detection control is performed based on an instruction given by the operator through the operation unit while an image is not formed, such as immediately after a unit has been replaced (before an image is formed next). Further, in the present exemplary embodiment, if the new product detection circuit 204 has detected that the process cartridge 200 is new, the control unit 140 does not perform the processing of the attachment state detection control.

If the operator has operated the execute button 114, the control unit 140 may skip the processes of steps S202 and S203 on the assumption that the attachment state detection control is to be performed.

7. High Voltage Conditions and Determination Technique

Next, a description is given of high voltage conditions and a technique for determining an attachment failure in the attachment state detection control.

In the present exemplary embodiment, the conditions of a high voltage to be applied to the charging roller 21 in the attachment state detection control are different from those when an image is normally formed. That is, when an image is formed, the present exemplary embodiment employs an AC charging method for superimposing a DC voltage on an AC voltage in applying a voltage to the charging roller 21 in a contact charging method. In the AC charging method, an oscillation voltage is obtained by superimposing a DC component corresponding to the required surface potential of the photosensitive member 1 on an AC component having a peak-to-peak voltage value equal to or greater than twice a discharge starting voltage Vth when a DC voltage is applied. Then, the obtained oscillation voltage is applied as a charging bias to the charging roller 21. In the present exemplary embodiment, when an image is formed, an oscillation voltage obtained by superimposing a DC voltage of 850 V on an AC voltage having a peak-to-peak voltage of 1900 Vpp and a frequency of 2.5 kHz in a 23° C. and 50% humidity environment is applied as a charging bias to the charging roller 21. In contrast, in the present exemplary embodiment, in the attachment state detection control, only a DC voltage as a test voltage is applied to the charging roller 21.

In view of the discharge starting voltage in a general gap, the following formula 1 is applied based on Paschen's Law.

$$Vg=312+6.2Z \quad (1)$$

In the above formula 1, Vg represents the voltage in the gap, and Z represents the gap distance.

If the relative permittivity of the photosensitive member 1 is taken into account in the above formula 1, the following formula 2 is applied.

$$Vth=\sqrt{77737.6*d/\epsilon r}+312+6.2*d/\epsilon r \quad (2)$$

In the above formula 2, Vth represents the discharge starting voltage when a DC voltage is applied, $\epsilon r$ represents the relative permittivity of the photosensitive member 1, and d represents the distance between the charging roller 21 and the photosensitive member 1 in the present exemplary embodiment. In the present exemplary embodiment, $\epsilon r$ is 2.5 F/m, d is 35 μm, and the discharge starting voltage Vth is 728 V.

Figure 15:
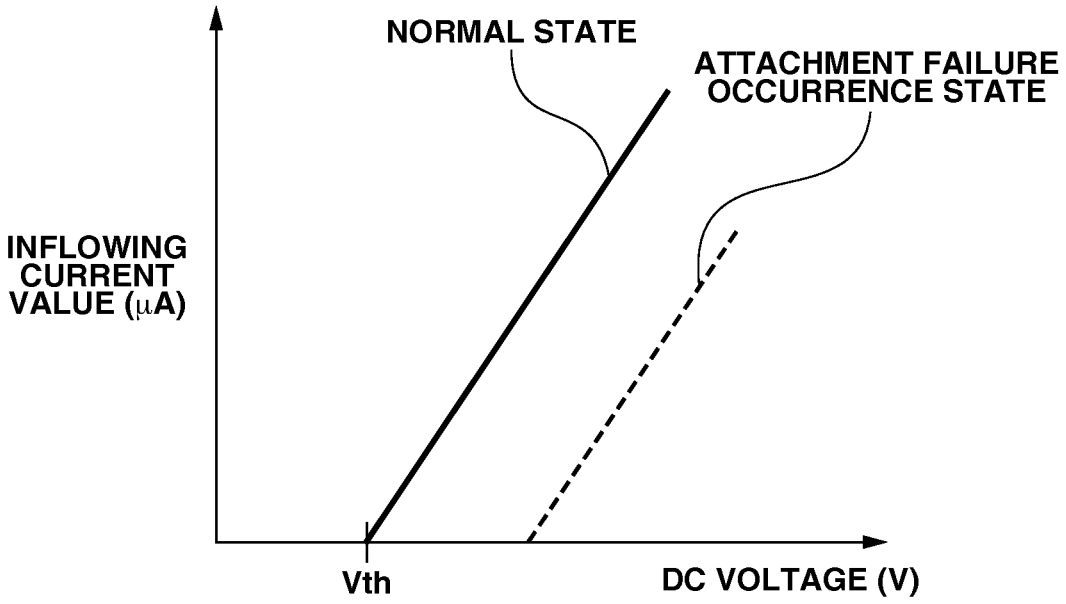
FIG. 15 is a graph illustrating the relationship between a DC voltage applied to the charging roller and an inflowing current.

In the present exemplary embodiment, it is determined, using the discharge starting voltage Vth, whether an attachment failure has occurred. FIG. 15 illustrates the relationship between the DC voltage value when a DC voltage is applied to the charging roller 21 and the detected inflowing current value, in the case where an attachment failure has not occurred (a normal state) and an attachment failure has occurred (an attachment failure occurrence state). The horizontal axis represents the DC voltage value, and the vertical axis represents the inflowing current value. A solid line represents the relationship in the normal state, and a dashed line represents the relationship in the attachment failure occurrence state.

Examples of the case where an attachment failure has occurred include the following two forms. The first case is where the distance between the charging roller 21 and the photosensitive member 1 is greater than a predetermined value (an assembly nominal value) (a contact failure). The second case is where the distance between the electrodes in the charging unit 202 and the cleaning unit 201, that is, the distance between the first and second inter-unit contact portions 216 and 224, is greater than a predetermined value (an assembly nominal value) (a contact point failure). Then, in these cases, it is necessary to apply a voltage higher than that in the normal state to reach the discharge starting voltage. For example, in the present exemplary embodiment, if a DC voltage of −900 V has been applied to the charging roller 21, an inflowing current of about −30 μA is detected in the normal state. In contrast, discharge cannot be performed in the attachment failure occurrence state, and therefore, 0 μA is detected.

These behaviors are compared with each other, thereby enabling the determination of whether an attachment failure has occurred. In the present exemplary embodiment, a DC voltage as a test voltage is applied to the charging roller 21 in the attachment state detection control. The DC voltage is equal to or greater than the discharge starting voltage Vth (in absolute value) when a DC voltage is applied in the normal state. Further, the inflowing current value at this time is detected by the measurement circuit 130. Then, the detected inflowing current value is compared with a predetermined value (a threshold) corresponding to the inflowing current value when the DC voltage value is applied in the normal state, the predetermined value stored in advance in the control unit 140. Then, if the detected inflowing current value is smaller than the threshold, it is determined that an attachment failure has occurred. The control unit 140 performs an operation in a mode for performing the above control.

Figure 16:
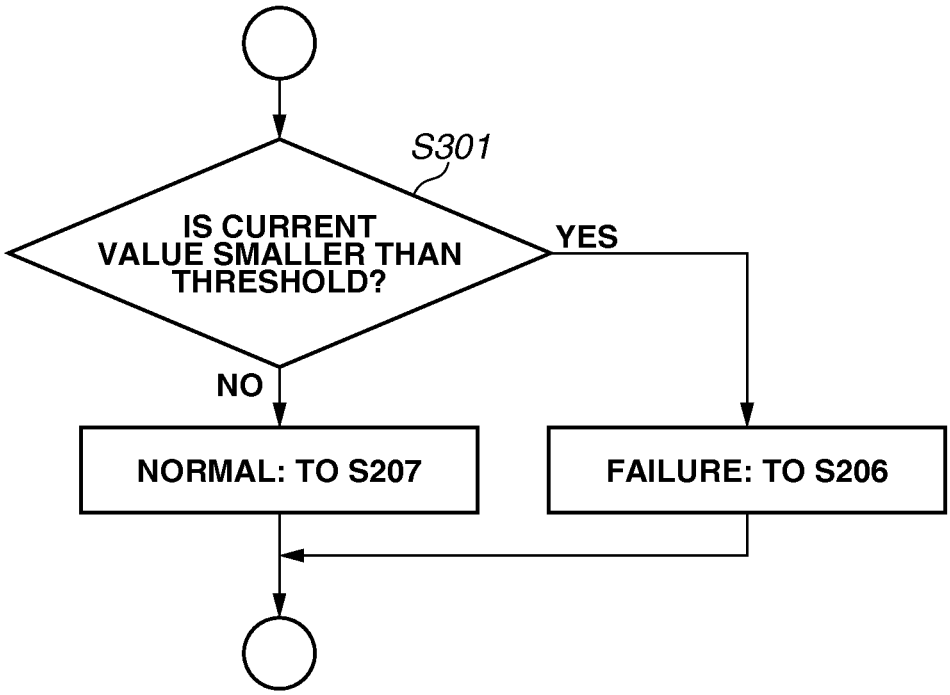
FIG. 16 is a flow diagram illustrating the process of determining an attachment failure in the attachment state detection control.

FIG. 16 illustrates in more detail the processing of the control unit 140 in step S205 in FIG. 14. That is, in step S204 in FIG. 14, the control unit 140 causes the charging power source 120 to output a DC voltage as a predetermined test voltage equal to or greater than the discharge starting voltage Vth to the charging roller 21 and causes the measurement circuit 130 to detect the inflowing current value. Then, in step S301 in FIG. 16, the control unit 140 compares the result of the detected inflowing current value with the above threshold. If the detected inflowing current value is smaller than the threshold (Yes in step S301), the processing proceeds to step S206 in FIG. 14. If the detected inflowing current value is equal to or greater than the threshold (No in step S301), the processing proceeds to step S207 in FIG. 14.

The technique for determining whether an attachment failure has occurred is not limited to that according to the present exemplary embodiment. The determination of whether an attachment failure has occurred may be made by comparing with a detected value the information about the relationship obtained in advance, between the DC voltage value and the inflowing current value in the normal state (including information indicating the difference that enables the determination that an attachment failure has occurred with respect to the relationship). Typically, as described above, high voltages before and after the discharge starting voltage are applied to the charging roller 21, and the inflowing currents at these times are detected by the measurement circuit 130. The inflowing currents are compared with the relationship stored in advance in the control unit 140 between the DC voltage value in the normal state and the inflowing current value.

As described above, in the present exemplary embodiment, the process cartridge 200, which includes the second unit (charging unit) 202 attachable to and detachable from the first unit (cleaning unit) 201, is attachable to and detachable from the image forming apparatus 100. The cleaning unit 201 includes the first electrical contact (first inter-unit contact portion) 216, and the charging unit 202 includes the second electrical contact (second inter-unit contact portion) 224, which is electrically connected to the first electrical contact point 216. Further, the image forming apparatus 100 includes the power source 120, which applies a voltage to the charging device 2 via the first and second electrical contact points 216 and 224, and the detection unit (measurement circuit) 130, which detects the current flowing when a voltage is applied to the charging device 2 from the power source 120. Further, the image forming apparatus 100 includes the control unit (control unit) 140, which performs the process of acquiring information about the state of attachment of the second unit 202 to the first unit 201 based on the detection result of the detection unit 130. Particularly, in the present exemplary embodiment, if the current detected by the measurement circuit 130 when a predetermined direct-current voltage has been applied to the charging device 2 is smaller than a predetermined value, the control unit 140 performs the process of providing a notification of predetermined information corresponding to a poor attachment state. At this time, it is desirable that the predetermined direct-current voltage as a test voltage should be a direct-current voltage having a value equal to or greater than the discharge starting voltage when a direct-current voltage is applied to the charging device 2 in the normal attachment state. The state of attachment is typically a state of the relative position of the charging roller 21 as a charging member with respect to the photosensitive member 1 and/or a state of the relative position of the second electrical contact point 224 with respect to the first electrical contact point 216.

As described above, according to the present exemplary embodiment, a failure in the attachment of the charging unit 202 to the process cartridge 200 (a failure in the attachment of the charging roller 21 to the process cartridge 200) can be detected, whereby it is possible to reduce the occurrence of a problem such as an image defect.

Next, a second exemplary embodiment of the present invention is described. The basic configuration and operation of an image forming apparatus according to the present exemplary embodiment are similar to those of the image forming apparatus according to the first exemplary embodiment. Thus, the components having functions and configurations similar or equivalent to those of the image forming apparatus according to the first exemplary embodiment are designated by the same numerals, and are not described in detail here.

In the present exemplary embodiment, in the attachment state detection control, only an AC voltage is applied to the charging roller 21 which is high voltage conditions different from those when an image is formed. When an AC voltage is thus used, it is desirable to determine based on two criteria as described below whether an attachment failure has occurred.

As described above, examples of the case where an attachment failure has occurred include the following two forms. That is, the first case is where the distance between the charging roller 21 and the photosensitive member 1 is greater than a nominal assembly value (a contact failure). The second case is where the distance between the electrode in the charging unit 202 and the electrode in the cleaning unit 201 is greater than an assembly nominal value (a contact point failure).

Figure 17:
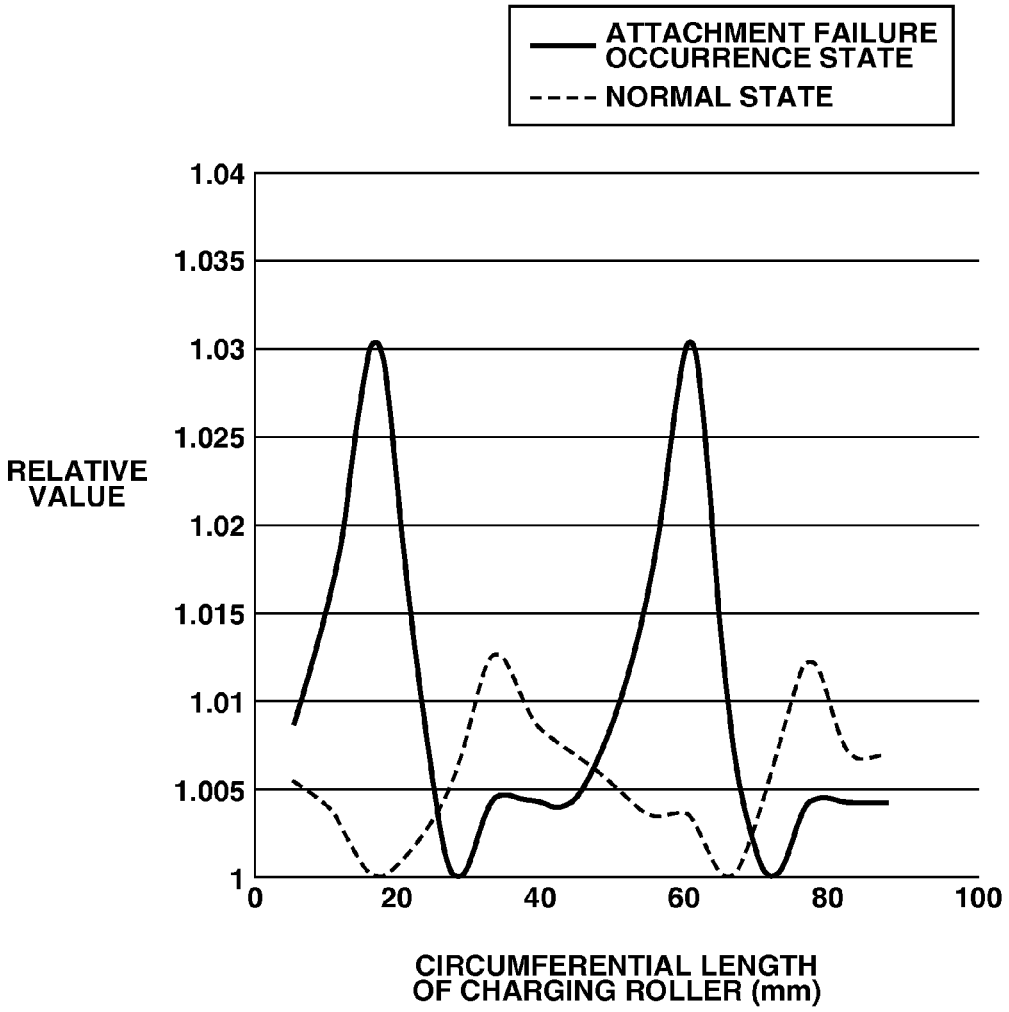
FIG. 17 is a graph illustrating the distribution of inflowing currents for one revolution around the charging roller, the inflowing currents acquired by applying an AC voltage to the charging roller.

For example, when a contact failure has occurred between the charging roller 21 and the photosensitive member 1 and if an AC voltage has been applied in the attachment state detection control, an inflowing current flows into the photosensitive member 1 unless the entirety of the charging roller 21 is not in contact with the photosensitive member 1. Therefore, in the present exemplary embodiment, in the attachment state detection control, the measurement circuit 130 detects the distribution of the inflowing current values (the total amounts of AC current) for one revolution around the charging roller 21 when an AC voltage is applied. Further, in the present exemplary embodiment, the inflowing current values detected in each position in the circumferential direction of the charging roller 21 are represented as relative values using the minimum value as a reference. Then, if the maximum value relative to the reference is greater than a predetermined value (a threshold), it is determined that an attachment failure has occurred. That is, it is possible to detect unevenness in the state of close contact of the charging roller 21 with the photosensitive member 1, as unevenness in the inflowing current values detected for one revolution around the charging roller 21. In the present exemplary embodiment, the threshold obtained in advance based on whether sufficiently uniform charging properties can be obtained is 1.03. For example, FIG. 17 illustrates the inflowing current values (the total amounts of AC current) for one revolution around the charging roller 21 as relative values with respect to the minimum value when an AC voltage having a peak-to-peak voltage of 1000 Vpp is applied. The horizontal axis represents the circumferential length of the charging roller 21, and the vertical axis represents the relative value. As indicated by a solid line in FIG. 17, if the distribution of the inflowing current values in which a relative value is greater than the threshold (1.03 in the present exemplary embodiment) has been detected, it can be determined that an attachment failure has occurred. It is desirable that the AC voltage (the peak-to-peak voltage) to be applied at this time should be a value smaller than the discharge starting point (twice the discharge starting voltage when a DC voltage is applied) as in the present exemplary embodiment to successfully detect unevenness in the contact state from the distribution of the inflowing current values.

Figure 18:
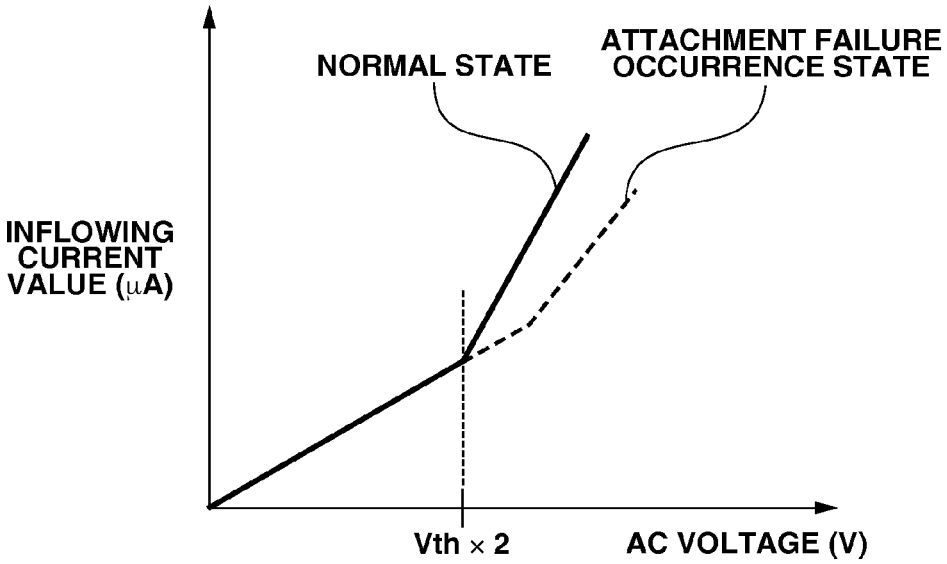
FIG. 18 is a graph illustrating the relationship between an AC voltage applied to the charging roller and an inflowing current.

Further, if a contact point failure has occurred between the electrodes in the charging unit 202 and the cleaning unit 201, a high voltage is not applied to the charging roller 21. Thus, it is not possible to detect the above distribution of the inflowing current values. In the present exemplary embodiment, assuming such a case, in the attachment state detection control, an attachment failure is determined based on the relationship between the AC voltage value when an AC voltage (a peak-to-peak voltage) equal to or greater than the discharge starting point (twice the discharge starting voltage when a DC voltage is applied) is applied as a test voltage, and the detected inflowing current value. For example, FIG. 18 illustrates the relationship between the AC voltage value (the peak-to-peak voltage value) and the inflowing current value when an AC voltage having a peak-to-peak voltage of 500 to 1500 Vpp is applied by changing the AC voltage at intervals of a peak-to-peak voltage of 100 Vpp. The horizontal axis represents the AC voltage value, and the vertical axis represents the inflowing current value (the total amount of AC current). As illustrated in FIG. 18, in the normal state, discharge is started at the AC voltage value equal to or greater than twice the discharge starting voltage Vth when a DC voltage is applied. In contrast, discharge is not started in the attachment failure occurrence state. Then, the slope of the AC voltage value equal to or greater than twice the discharge starting voltage Vth is detected and compared with a predetermined value (a threshold) corresponding to the slope of the AC voltage in the normal state. Then, if the detected slope is smaller than the threshold, it can be determined that an attachment failure has occurred. In other words, the above slope represents the amount of change in the alternating current (the inflowing current) when the peak-to-peak voltage of the AC voltage is increased by a predetermined amount.

Figure 19:
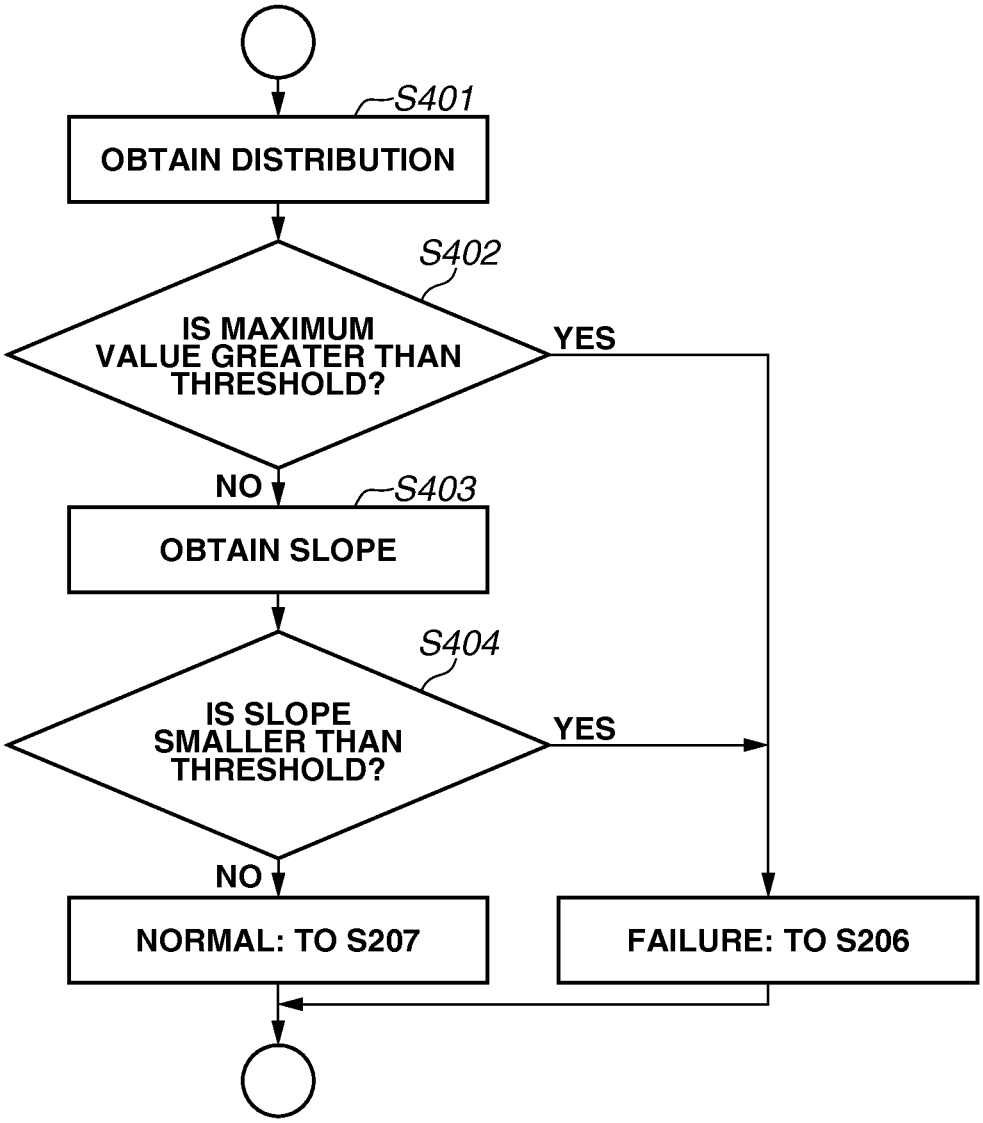
FIG. 19 is a flow diagram illustrating another example of the process of determining an attachment failure in the attachment state detection control.

FIG. 19 illustrates in more detail the processing of the control unit 140 in step S205 in FIG. 14. In step S204 in FIG. 14, the control unit 140 causes the charging power source 120 to output an AC voltage having a value smaller than the discharge starting point to the charging roller 21 and causes the measurement circuit 130 to detect the inflowing current values for at least one revolution around the charging roller 21. Further, in step S204 in FIG. 14, the control unit 140 causes the charging power source 120 to output an AC voltage equal to or greater than the discharge starting point to the charging roller 21 by changing the AC voltage at predetermined intervals and causes the measurement circuit 130 to detect the inflowing current values. Then, in step S401 in FIG. 19, the control unit 140 obtains the distribution of relative values using as a reference the minimum value of the inflowing current values for one revolution around the charging roller 21 when the AC voltage having the value smaller than the discharge starting point has been applied. Then, in step S402 in FIG. 19, the control unit 140 compares the maximum value in the obtained distribution with the threshold. If the maximum value is greater than the threshold (Yes in step S402), the processing proceeds to step S206 in FIG. 14. If the maximum value is less than or equal to the threshold (No in step S402), the processing proceeds to step S403 in FIG. 19. Then, in step S403 in FIG. 19, the control unit 140 obtains the slope of the relationship between the AC voltage value and the inflowing current value when the AC voltage equal to or greater than the discharge starting point has been applied. Then, in step S404 in FIG. 19, the control unit 140 compares the obtained slope with the predetermined value (the threshold). If the obtained slope is smaller than the threshold (Yes in step S404), the processing proceeds to step S206 in FIG. 14. If the obtained slope is equal to or greater than the threshold (No in step S404), the processing proceeds to step S207 in FIG. 14.

In the present exemplary embodiment, when an AC voltage is applied, it is determined, using both the above two criteria, whether an attachment failure has occurred. Thus, if either of the two forms of an attachment failure has occurred, it is possible to detect the attachment failure. However, for example, when either of the forms of an attachment failure is more likely to occur (or less likely to occur), either of the two criteria may be used as a user desires.

Further, in the present exemplary embodiment, it is determined whether an attachment failure has occurred, based on the slope of the relationship between the inflowing current value and the AC voltage value (the peak-to-peak voltage value) when an AC voltage equal to or greater than the discharge starting point is applied. The determination technique, however, is not limited to this method. Alternatively, for example, a threshold corresponding to the inflowing current value in the normal state when a predetermined AC voltage equal to or greater than the discharge starting point is applied may be compared with the detected inflowing current value when the predetermined AC voltage is applied. If the inflowing current value is smaller than the threshold, it can be determined that an attachment failure has occurred. The determination of whether an attachment failure has occurred may be made by comparing a detected value with information based on the relationship obtained in advance between the AC voltage value and the inflowing current value in the normal state (including information indicating the difference that, with respect to the relationship, enables the determination that an attachment failure has occurred).

As described above, in the present exemplary embodiment, the control unit 140 applies a predetermined alternating-current voltage to the charging device 2 and acquires the distribution of the current values using the measurement circuit 130. Then, if there is a current value greater than a reference in the acquired distribution of the current values, the control unit 140 performs the process of providing a notification of predetermined information corresponding to a poor attachment state. At this time, it is desirable that the predetermined alternating-current voltage should be an alternating-current voltage having a peak-to-peak voltage value smaller than twice the discharge starting voltage when a direct-current voltage is applied to the charging device 2 in the normal attachment state. Further, in the present exemplary embodiment, also in the following case, the control unit 140 performs the process of providing a notification of predetermined information corresponding to a poor attachment state. More specifically, the current detected by the measurement circuit 130 when a predetermined alternating-current voltage is applied as a test voltage to the charging device 2, is smaller than a predetermined value. Alternatively, the slope of the relationship between the current values and the alternating-current voltage values acquired by the measurement circuit 130 when predetermined alternating-current voltages having a plurality of different values are applied is smaller than a predetermined value. At this time, it is desirable that the predetermined alternating-current voltages should be alternating-current voltages having peak-to-peak voltage values equal to or greater than twice the discharge starting voltage when a direct-current voltage is applied to the charging device 2 in the normal attachment state.

As described above, also with the configuration of the present exemplary embodiment, it is possible to obtain effects similar to those of the first exemplary embodiment.

Other Exemplary Embodiments

The present invention has been described based on specific exemplary embodiments, but is not limited to the above exemplary embodiments.

Figure 20A:
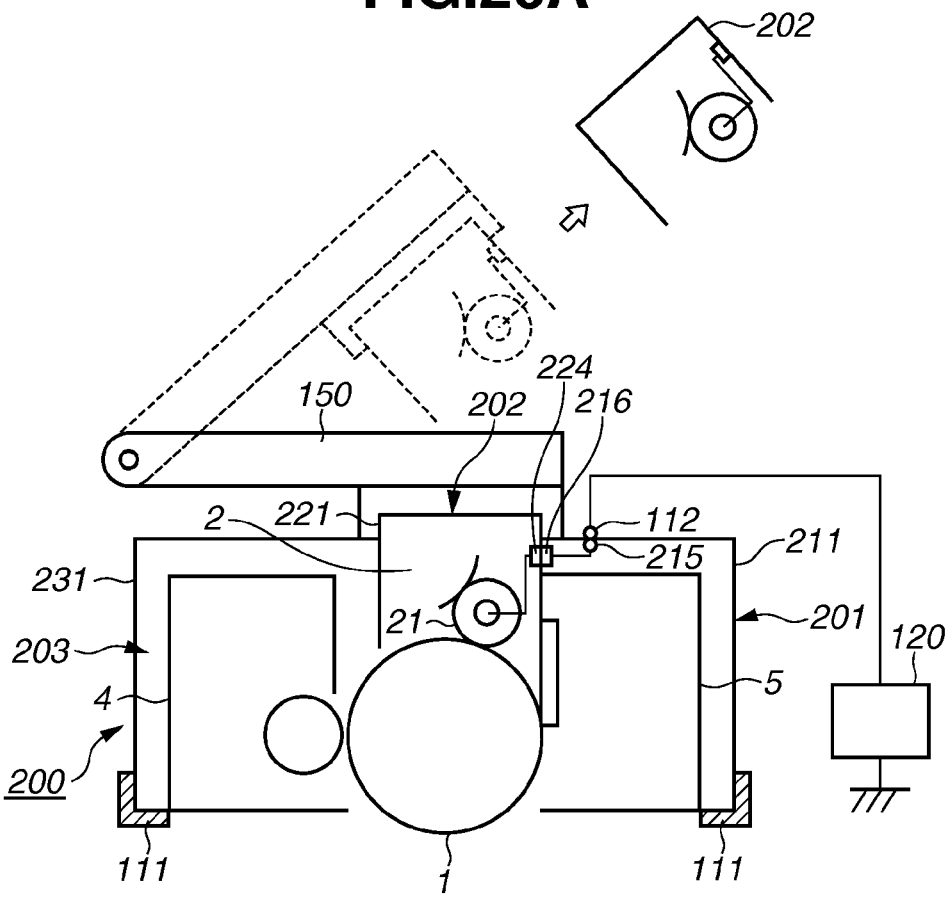
FIGS. 20A and 20B are schematic diagrams illustrating other forms of the present invention.

FIG. 20A schematically illustrates the case where a unit (process cartridge) 200 in which a cleaning unit 201 and a development unit 203 are combined together, and a charging unit 202 are separately attachable to and detachable from the apparatus main body 110. For example, the charging unit 202 can be configured to be installed in (attached or assembled to) and removed (separated) from the process cartridge 200 by a supporting member 150 provided in the apparatus main body 110. A charging bias is applied to a charging roller 21 of the charging unit 202 by a power source 120 via a first electrical contact point 216 provided in the process cartridge 200 and a second electrical contact point 224 provided in the charging unit 202. In this case, if the charging unit 202 has been replaced separately from the process cartridge 200, a failure in the attachment of the charging unit 202 to the process cartridge 200 may occur. To deal with this problem, by performing attachment state detection control similar to that according to the above exemplary embodiments, it is possible to determine whether such an attachment failure has occurred. More specifically, in this case, similarly to the above exemplary embodiments, the control unit 140 can perform the process of acquiring information about the state of the second unit (charging unit) 202 attached to the first unit (process cartridge) 200 based on the detection result of the measurement circuit 130.

Figure 20B:
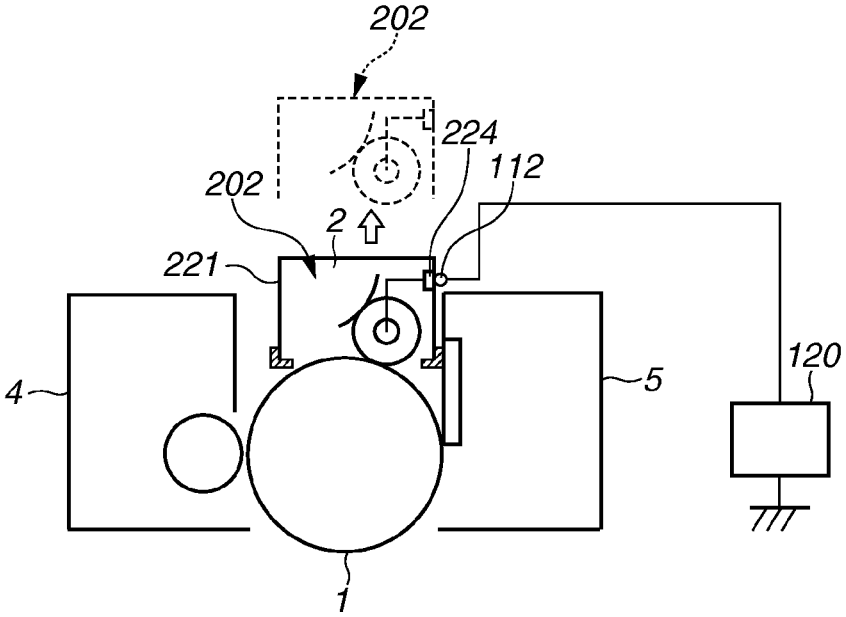

FIG. 20B schematically illustrates the case where a charging unit 202 (a charging device 2) is individually attachable to and detachable from the apparatus main body 110. A charging bias is applied to a charging roller 21 of the charging unit 202 by a power source 120 via a first electrical contact point 112 provided in the apparatus main body 110 and a second electrical contact point 224 provided in the charging unit 202. In this case, if the charging unit 202 has been individually replaced in the apparatus main body 110, a failure in attaching the charging unit 202 to the apparatus main body 110 may occur. To deal with this problem, by performing attachment state detection control similar to that according to the above exemplary embodiments, it is possible to determine whether such an attachment failure has occurred. More specifically, in this case, the control unit 140 can perform the process of acquiring information about the state of the charging unit 202 attached to the apparatus main body 110 based on the detection result of the measurement circuit 130.

Further, in the above exemplary embodiments, a case has been described where a charging unit can be individually replaced as a process unit. The present invention, however, is not limited to these embodiments. Alternatively, the present invention is similarly applicable to another process unit such as a development unit. While an image is not formed, for example, immediately after a unit has been replaced, typically, attachment state detection control is performed under high voltage conditions different from those while an image is formed. Thus, it is possible to determine, using a technique similar to that according to the above exemplary embodiments, whether an attachment failure has occurred in any process unit. For example, the state of the development unit 203 attached to the cleaning unit 201, instead of the charging unit 202 in the above exemplary embodiments, may be detected. In this case, the high voltage necessary to cause the development device 4 to effectively function as a process unit is applied via electrical contacts between the cleaning unit 201 and the development unit 203. Also in such a case, it is possible to detect a contact point failure at the electrical contacts by performing attachment state detection control similar to that according to the above exemplary embodiments.

Further, a charging member such as a charging roller does not necessarily need to be in contact with the surface of a photosensitive member that is a member to be charged. If an area that allows discharge based on Paschen's Law is secured between the charging member and the photosensitive member, the charging member and the photosensitive member may be placed in proximity to each other in a non-contact manner with a gap of several tens of micrometers therebetween, for example. In this case, the method of bringing the charging member into contact with or into proximity to the member to be charged and charging the member to be charged by discharge that occurs in the minute gap is referred to as a "contact or proximity charging method" or simply as a "contact charging method".

As in the above exemplary embodiments, if the operator has given an instruction through the operation unit, an operation in a mode is performed where the control unit 140 applies a test voltage having an absolute value greater than the discharge starting voltage (attachment state detection control). Then, it is determined whether an error indication is to be given on the display unit, based on the current value of the current flowing between the charging member and the photosensitive member when the test voltage is applied. Thus, it is possible to notify the operator that the charging member is attached to the process cartridge in a shifted manner, without spending extra time until it becomes possible to start forming an image because it is not necessary to perform the mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-202551 filed Sep. 27, 2013, which is hereby incorporated by reference herein in its entirety.

What is claimed is:

1. An image forming apparatus comprising:

a photosensitive member;

a charging member configured to discharge in contact with the photosensitive member to charge a surface of the photosensitive member;

a power source configured to apply a voltage to the charging member;

a toner image forming unit configured to form a toner image on the surface of the photosensitive member charged by the charging member;

a unit including at least the photosensitive member and the charging member and attachable to and detachable from a main body of the image forming apparatus, the charging member being attachable to and detachable from the unit;

a current detection unit configured to detect a current flowing between the charging member and the photosensitive member;

an operation unit configured to be operated by an operator to give an instruction to the image forming apparatus, the operation unit including a display unit configured to display information to the operator; and a control unit configured to perform an operation in a mode for applying to the charging member a predetermined test voltage having an absolute value greater than a discharge starting voltage at which the discharge is started between the charging member, the photosensitive member and causing the current detection unit to detect a current when the test voltage has been applied and not forming an image on a recording material based on the instruction from the operation unit, wherein if an absolute value of the current detected by the current detection unit is smaller than a predetermined value when the predetermined test voltage has been applied to the charging member in the mode, the error indication is given on the display unit.

2. The image forming apparatus according to claim 1, wherein the predetermined test voltage is an alternating-current voltages having peak-to-peak voltages.

3. An image forming apparatus comprising:

a photosensitive member;

a charging member configured to discharge in contact with the photosensitive member to charge a surface of the photosensitive member;

a power source configured to apply a voltage to the charging member;

a toner image forming unit configured to form a toner image on the surface of the photosensitive member charged by the charging member;

a unit including at least the photosensitive member and the charging member and attachable to and detachable from a main body of the image forming apparatus, the charging member being attachable to and detachable from the unit;

a current detection unit configured to detect a current flowing between the charging member and the photosensitive member;

an operation unit configured to be operated by an operator to give an instruction to the image forming apparatus, the operation unit including a display unit configured to display information to the operator; and a control unit configured to perform an operation in a mode for applying to the charging member a predetermined test voltage having an absolute value greater than a discharge starting voltage at which the discharge is started between the charging member, the photosensitive member and causing the current detection unit to detect a current when the test voltage has been applied and not forming an image on a recording material based on the instruction from the operation unit, wherein the mode operates only in accordance with an operation instruction from the operation unit, wherein the control unit determines whether to give an error indication on the display unit or not based on an amount of change in a plurality of detected current values.

4. The image forming apparatus according to claim 3, wherein the control unit gives an error indication in a case where the amount of change which is calculated based on a plurality of test voltage values and a plurality of detected current values is smaller than a predetermined value.

5. The image forming apparatus according to claim 4, wherein the predetermined test voltage is an alternating-current voltages having peak-to-peak voltages.

6. The image forming apparatus according to claim 3, wherein the charging member can rotate in contact with the photosensitive member, the control unit applies alternating-current voltages in the mode when a plurality of different portions of the charging member in a circumferential direction thereof are in contact with the photosensitive member, peak-to-peak voltages of the alternating-current voltages are values smaller than the discharge starting voltage at which the discharge is started between the charging member and the photosensitive member, and based on alternating currents detected by the current detection unit when the alternating-current voltages have been applied, the control unit determines whether an error indication is to be given on the display unit.

7. An image forming apparatus comprising:

a photosensitive member;

a charging member configured to discharge in contact with the photosensitive member to charge a surface of the photosensitive member;

a power source configured to apply a voltage to the charging member;

a toner image forming unit configured to form a toner image on the surface of the photosensitive member charged by the charging member;

a unit including at least the photosensitive member and the charging member and attachable to and detachable from a main body of the image forming apparatus, the charging member being attachable to and detachable from the unit;

a current detection unit configured to detect a current flowing between the charging member and the photosensitive member;

an operation unit configured to be operated by an operator to give an instruction to the image forming apparatus, the operation unit including a display unit configured to display information to the operator; and a control unit configured to perform an operation in a mode for applying to the charging member a predetermined test voltage having an absolute value greater than a discharge starting voltage at which the discharge is started between the charging member, the photosensitive member and causing the current detection unit to detect a current when the test voltage has been applied and not forming an image on a recording material, based on the instruction from the operation unit;

wherein the mode operates only in accordance with an operation instruction from the operation unit, wherein the control unit determines, based on the current detected by the current detection unit in the mode, whether an error indication is to be given on the display unit.

8. The image forming apparatus according to claim 7, wherein the control unit determines whether to give an enor indication on the display unit or not based on a plurality of detected current values by applying a plurality of test voltages each of which having different voltage value.

9. The image forming apparatus according to claim 7, wherein an alternating voltage is applied to the charging member when executing the mode.

10. The image forming apparatus according to claim 7, wherein a mode input unit configured to execute the mode is displayed on a display unit.

11. The image forming apparatus according to claim 10, wherein the mode input unit is different from an input unit configured to execute an image formation.

* * * * *